US010739702B2

(12) United States Patent
Ogino et al.

(10) Patent No.: US 10,739,702 B2
(45) Date of Patent: Aug. 11, 2020

(54) DEVELOPER ACCOMMODATING UNIT, CARTRIDGE AND IMAGE FORMING APPARATUS

(71) Applicant: CANON KABUSHIKI KAISHA, Tokyo (JP)

(72) Inventors: Hiroki Ogino, Mishima (JP); Kojiro Yasui, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/502,412

(22) Filed: Jul. 3, 2019

(65) Prior Publication Data

US 2020/0012213 A1 Jan. 9, 2020

(30) Foreign Application Priority Data

Jul. 6, 2018 (JP) ..... 2018-128933
Apr. 5, 2019 (JP) ..... 2019-072587

(51) Int. Cl.
*G03G 15/08* (2006.01)

(52) U.S. Cl.
CPC ..... *G03G 15/0891* (2013.01); *G03G 15/0806* (2013.01)

(58) Field of Classification Search
CPC ..... G03G 15/0891; G03G 15/0806; G03G 15/0808
See application file for complete search history.

(56) References Cited

U.S. PATENT DOCUMENTS

| | | | |
|---|---|---|---|
| 7,079,787 | B2 | 7/2006 | Ogino et al. |
| 7,127,192 | B2 | 10/2006 | Batori et al. |
| 7,418,225 | B2 | 8/2008 | Morioka et al. |
| 9,146,500 | B2 | 9/2015 | Uesugi et al. |
| 9,152,081 | B2 | 10/2015 | Yasui et al. |
| 9,207,581 | B2 | 12/2015 | Wada et al. |
| 9,291,942 | B2 | 3/2016 | Matsuzaki et al. |
| 9,302,801 | B2 | 4/2016 | Matsumura et al. |
| 9,304,439 | B2 | 4/2016 | Matsuzaki et al. |
| 9,304,440 | B2 | 4/2016 | Yoshida et al. |
| 9,341,983 | B2 | 5/2016 | Yoshida et al. |

(Continued)

FOREIGN PATENT DOCUMENTS

| | | |
|---|---|---|
| JP | H05-216304 A | 8/1993 |
| JP | H05-307326 A | 11/1993 |

(Continued)

*Primary Examiner* — Sandra Brase
(74) *Attorney, Agent, or Firm* — Venable LLP

(57) ABSTRACT

A developer accommodating unit includes a developer container provided with an opening at a lower portion thereof with respect to a direction of gravitation in an attitude during use and configured to accommodate a developer; a developer carrying member mounted at the opening and configured to carry the developer; and a feeding member provided in the developer container and configured to feed the developer in the developer container toward the developer carrying member. The feeding member is swingable about a predetermined supporting point as a swing center and is configured so that maximum acceleration when the feeding member moves toward the developer carrying member is smaller than maximum acceleration when the feeding member moves away from the developer carrying member.

24 Claims, 24 Drawing Sheets

(56) References Cited

U.S. PATENT DOCUMENTS

| | | | | |
|---|---|---|---|---|
| 9,360,831 | B2 | 6/2016 | Matsuzaki et al. | |
| 9,366,994 | B2 | 6/2016 | Shinohara et al. | |
| 9,383,678 | B2 | 7/2016 | Furutani et al. | |
| 9,529,304 | B2 | 12/2016 | Uesugi et al. | |
| 9,599,930 | B2 | 3/2017 | Matsuzaki et al. | |
| 9,665,040 | B2 | 5/2017 | Matsuzaki et al. | |
| 9,715,191 | B2 | 7/2017 | Ogino et al. | |
| 9,885,978 | B2 | 2/2018 | Matsuzaki et al. | |
| 10,001,727 | B2 | 6/2018 | Matsuzaki et al. | |
| 10,162,289 | B2 | 12/2018 | Matsuzaki et al. | |
| 10,175,609 | B2 | 1/2019 | Matsuzaki et al. | |
| 2016/0097993 | A1 | 4/2016 | Shinohara et al. | |
| 2016/0282757 | A1* | 9/2016 | Ogino ..... | G03G 15/0865 |
| 2016/0282762 | A1* | 9/2016 | Yamaguchi ..... | G03G 15/0889 |
| 2017/0299978 | A1* | 10/2017 | Motohashi ..... | G03G 15/0812 |
| 2017/0322512 | A1 | 11/2017 | Kamoshida et al. | |
| 2019/0094759 | A1 | 3/2019 | Matsuzaki et al. | |
| 2019/0113865 | A1 | 4/2019 | Matsuzaki et al. | |

FOREIGN PATENT DOCUMENTS

| | | | |
|---|---|---|---|
| JP | 2002-196585 | A | 7/2002 |
| JP | 2016-071299 | A | 5/2016 |

* cited by examiner

DEVELOPER ACCOMMODATING UNIT, CARTRIDGE AND IMAGE FORMING APPARATUS

FIELD OF THE INVENTION AND RELATED ART

The present invention relates to a developer accommodating unit for use with an image forming apparatus such as a copying machine or a printer, and relates to a cartridge including the developer accommodating unit and the image forming apparatus including the developer accommodating unit.

In an image forming apparatus disclosed in Japanese Laid-Open Patent Application (JP-A) 2002-196585, a toner feeding member for feeding a developer, accommodated inside a toner container of a developing unit provided so as to be mountable in and dismountable from an apparatus main assembly, toward a developing roller while stirring the developer is provided.

However, in JP-A 2002-196585, the toner feeding member feeds toner toward the developing roller while rotating. For this reason, when the toner feeding member rotates in a direction in which the toner moves away from the developing roller, a part of the toner is fed in the direction in which the toner moves away from the developing roller, and therefore supply of the toner toward the developing roller becomes unstable.

SUMMARY OF THE INVENTION

The present invention has solved the above problem, and a principal object thereof is to provide a developer accommodating unit capable of stabilizing supply of a developer toward a developer carrying member.

According to an aspect of the present invention, there is provided a developer accommodating unit comprising: a developer container provided with an opening at a lower portion thereof with respect to a direction of gravitation in an attitude during use and configured to accommodate a developer; a developer carrying member mounted at the opening and configured to carry the developer; and a feeding member provided in the developer container and configured to feed the developer in the developer container toward the developer carrying member, wherein the feeding member is swingable about a predetermined supporting point as a swing center and is configured so that maximum acceleration when the feeding member moves toward the developer carrying member is smaller than maximum acceleration when the feeding member moves away from the developer carrying member.

Further features of the present invention will become apparent from the following description of exemplary embodiments with reference to the attached drawings.

Figure 10:
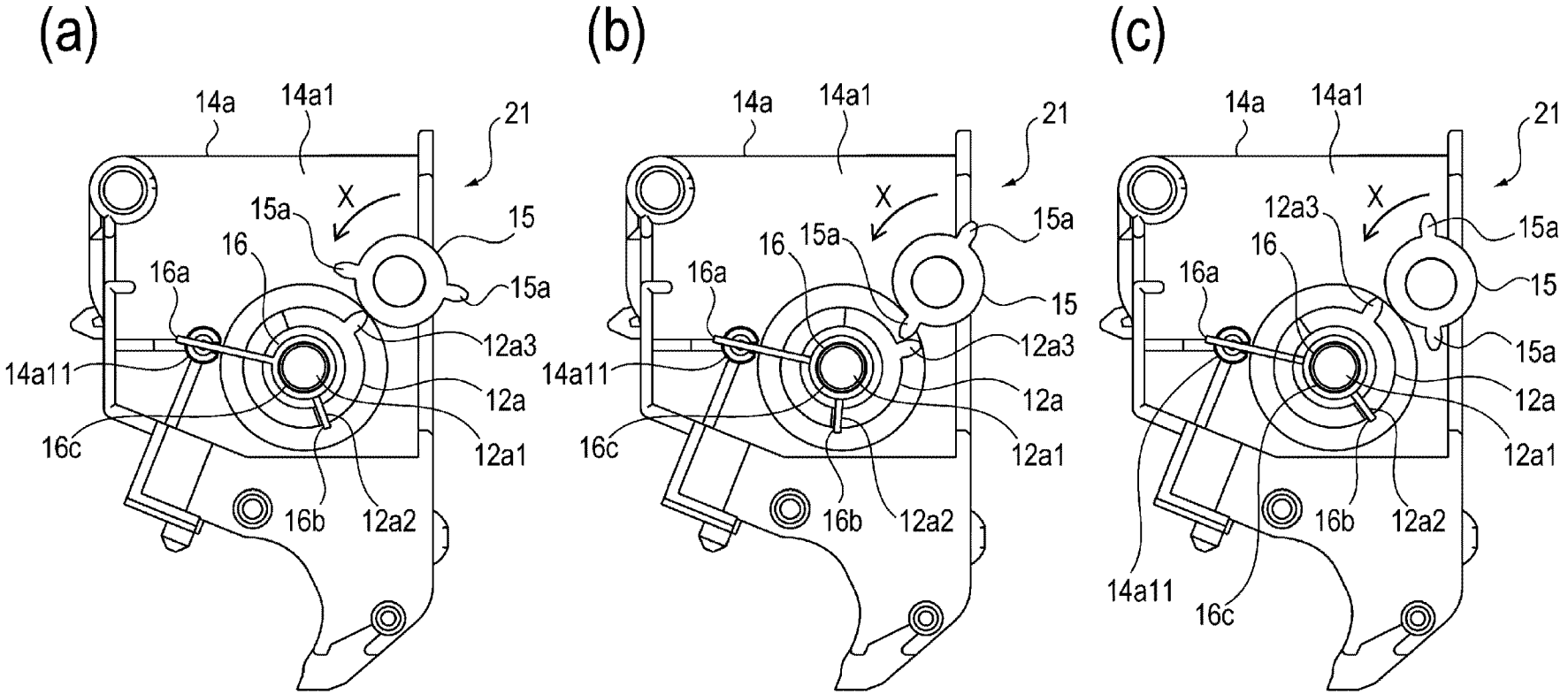

Parts (a), (b) and (c) of FIG. 10 are side view showing a structure of the developer feeding portion in the First Embodiment.

Figure 11:
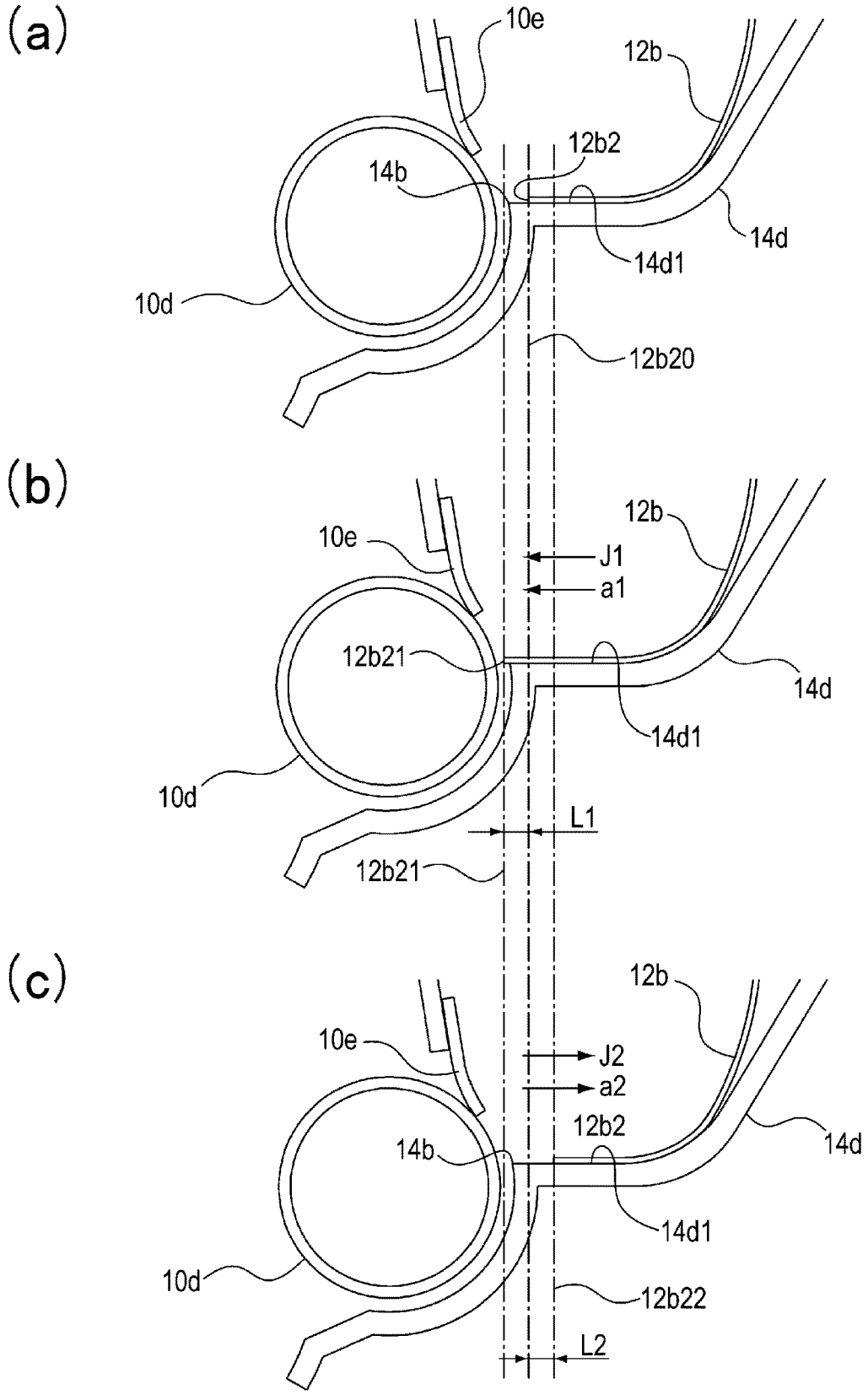

Parts (a), (b) and (c) of FIG. 11 are sectional view showing a structure of the developer feeding portion in the First Embodiment.

Figure 12:
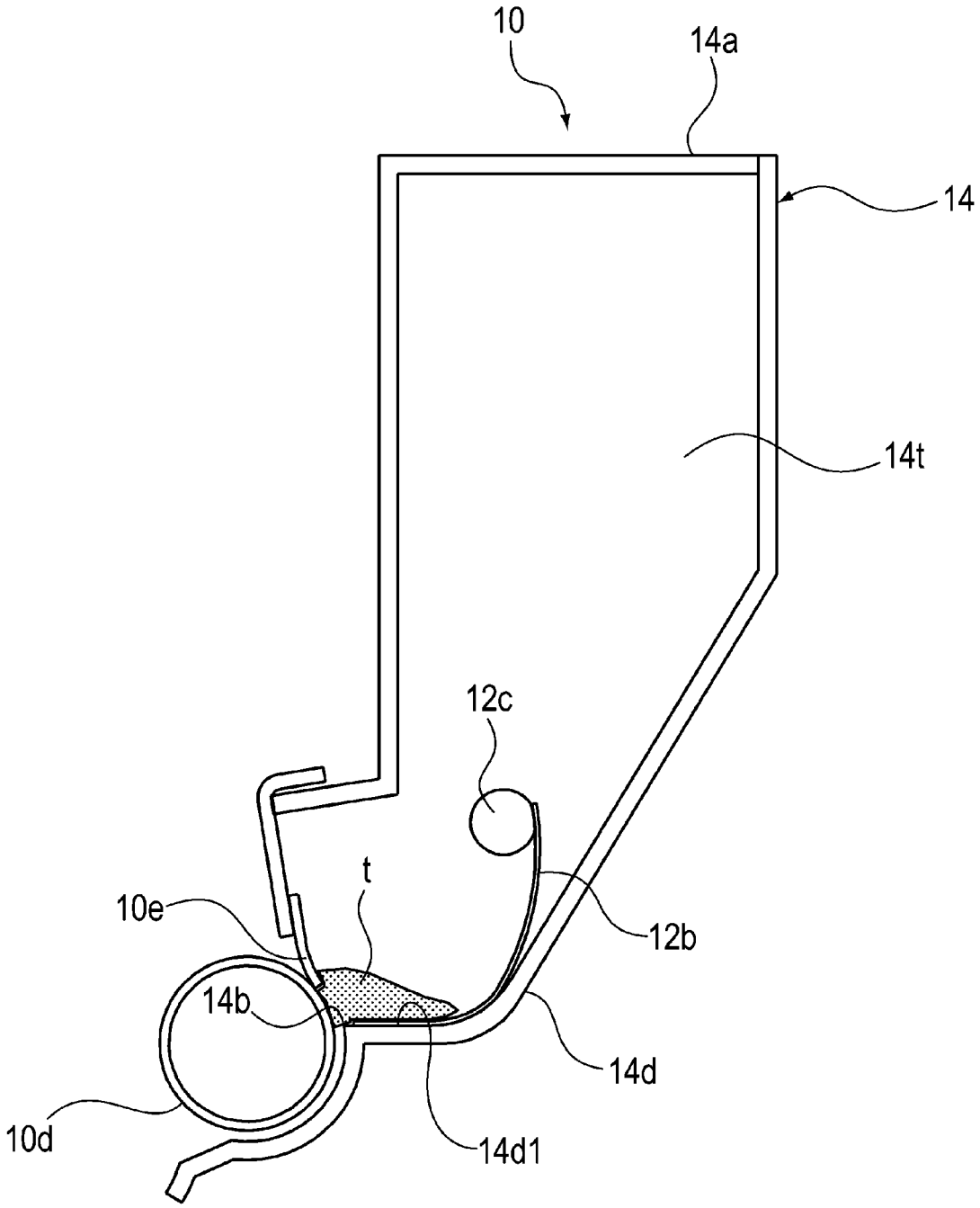

FIG. 12 is a sectional view showing a structure of a developing unit in the First Embodiment.

Figure 13:
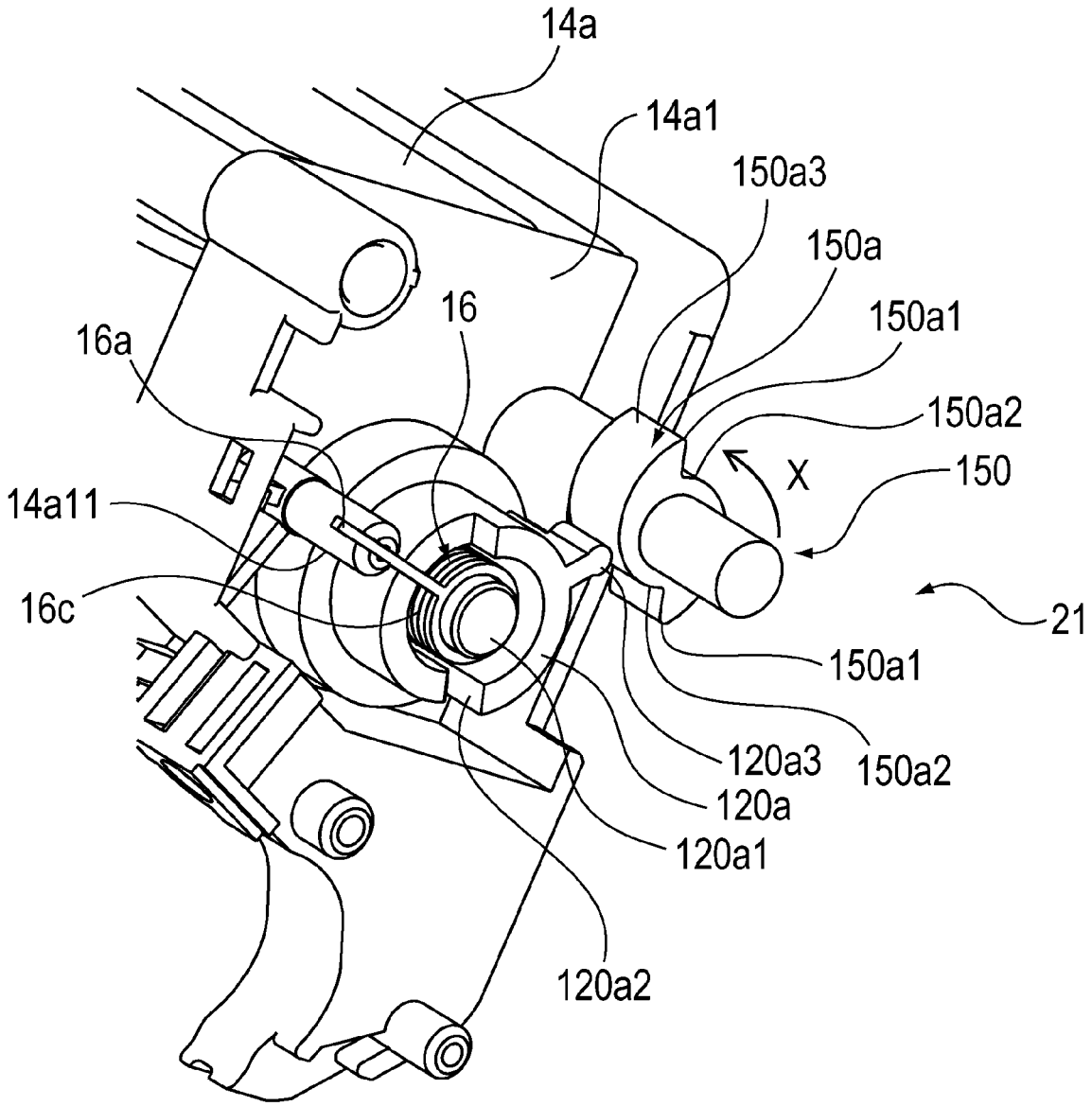

FIG. 13 is a perspective view showing a structure of a developer feeding portion in Second Embodiment.

Figure 14:
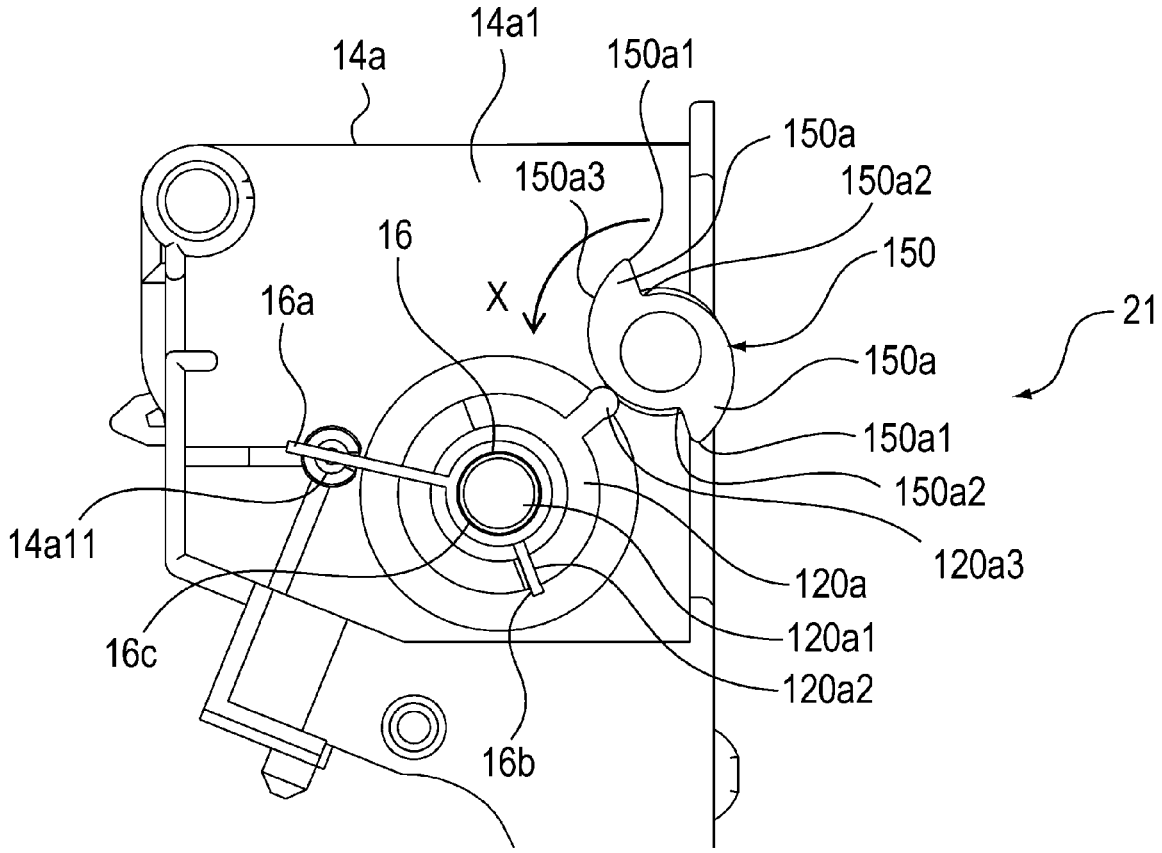

FIG. 14 is a side view showing a structure of the developer feeding portion in the Second Embodiment.

Figure 15:
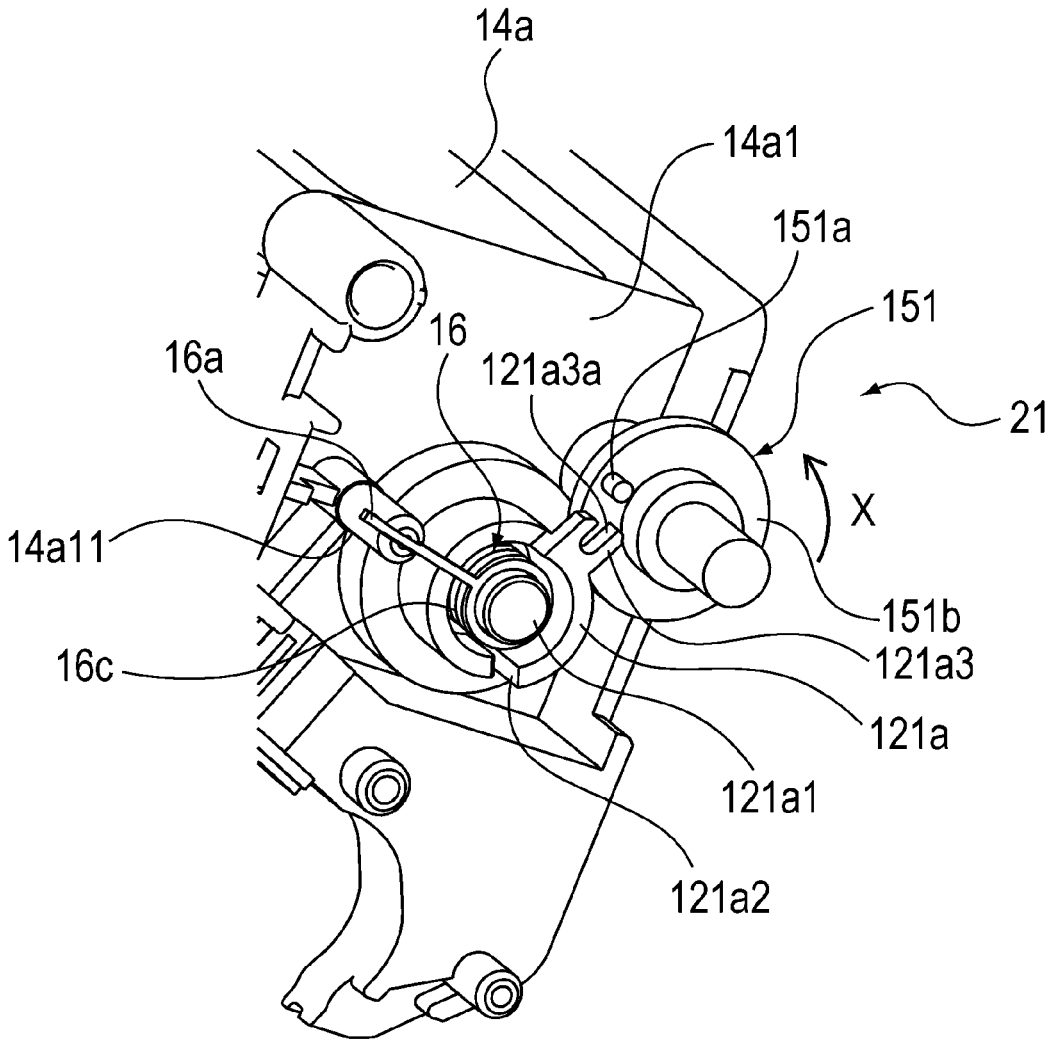

FIG. 15 is a perspective view showing a structure of a developer feeding portion in Third Embodiment.

Figure 16:
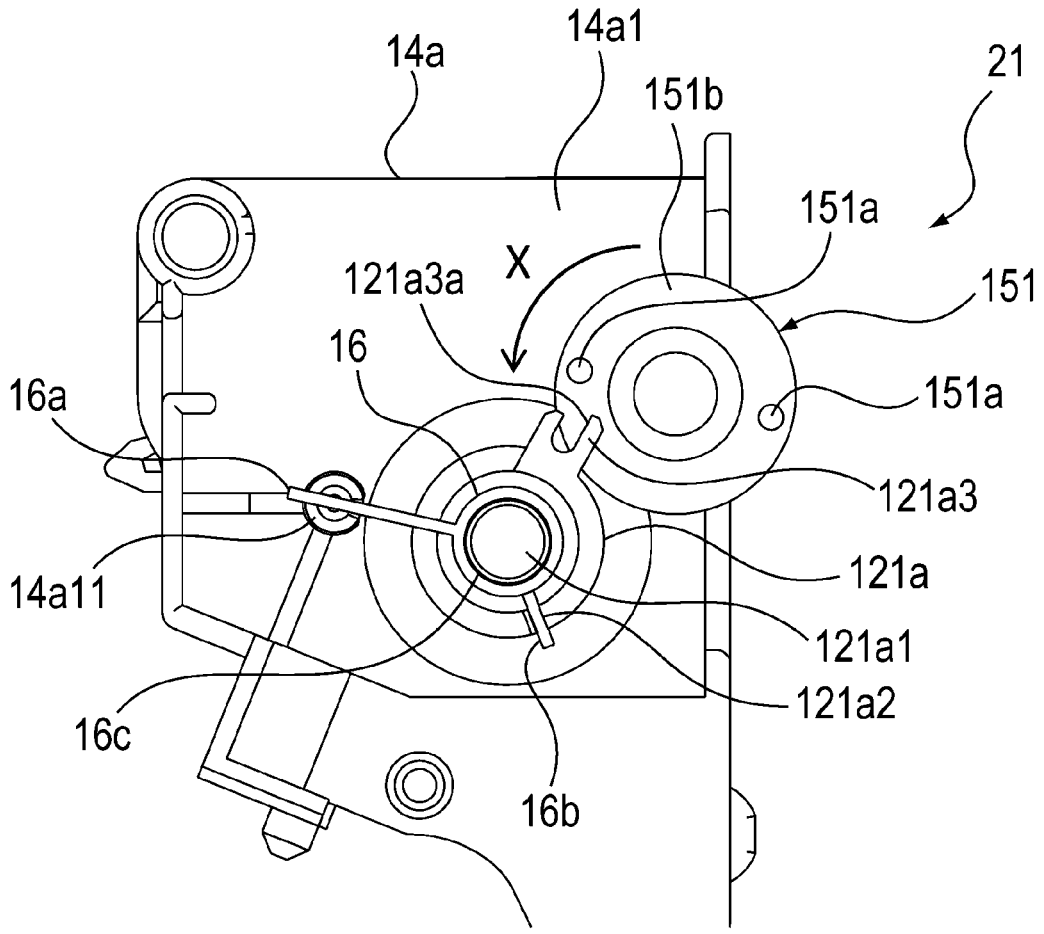

FIG. 16 is a side view showing a structure of the developer feeding portion in the Third Embodiment.

Figure 17:
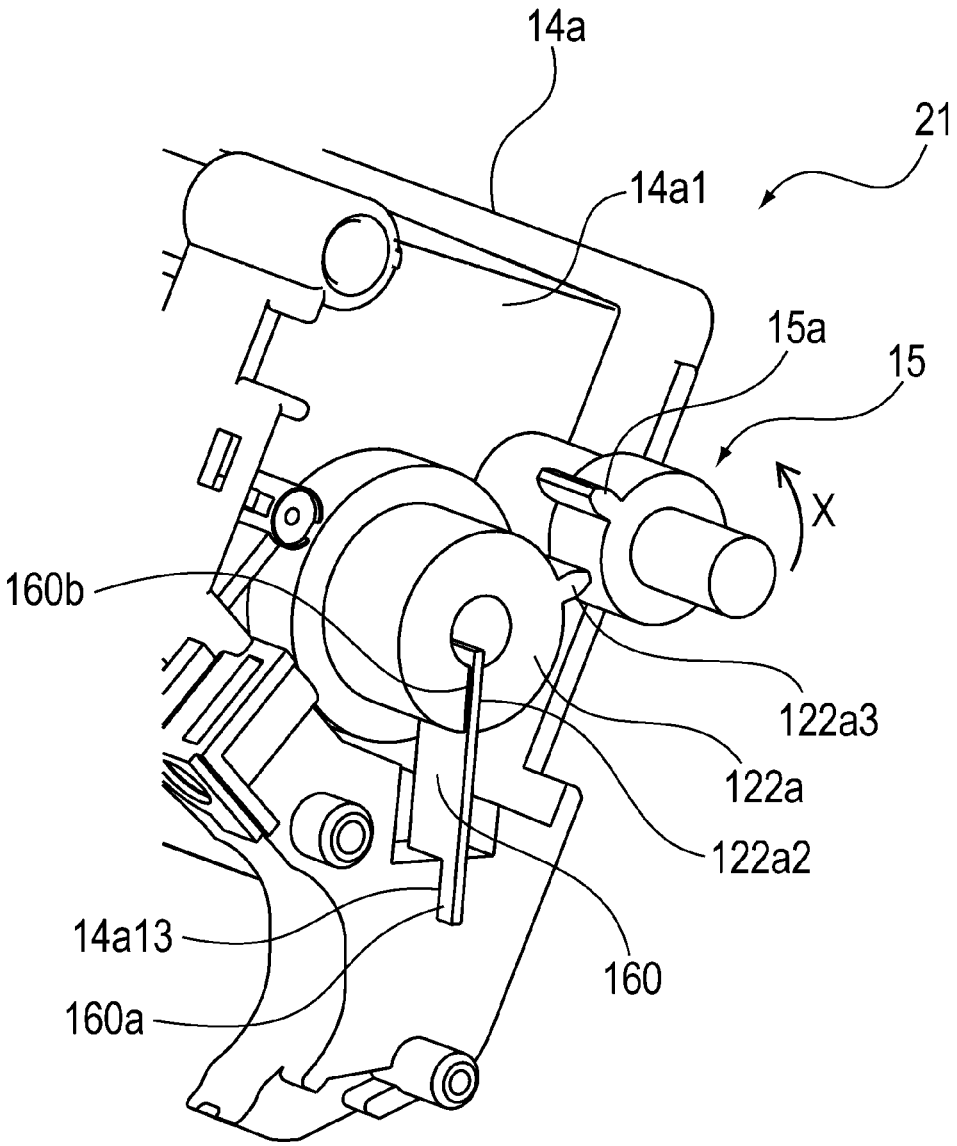

FIG. 17 is a perspective view showing a structure of a developer feeding portion in Fourth Embodiment.

Figure 18:
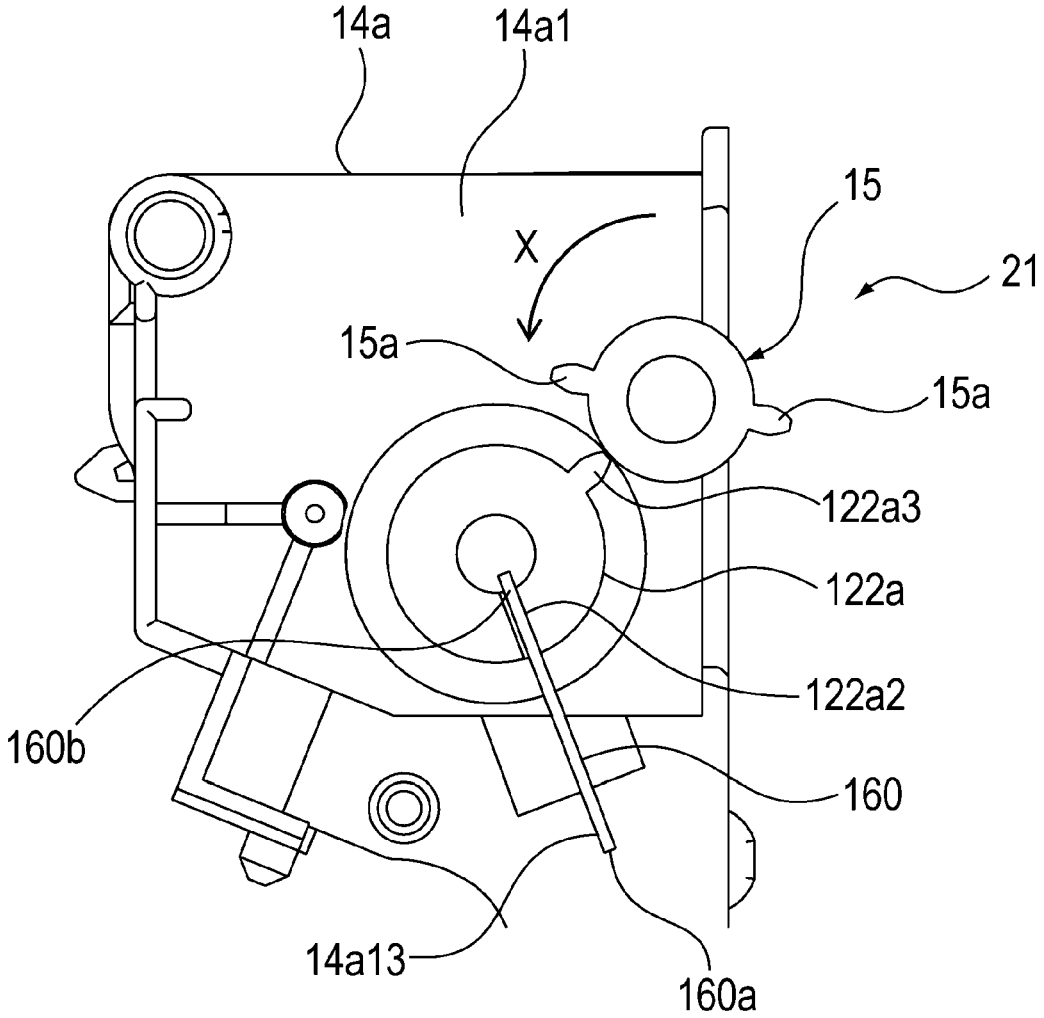

FIG. 18 is a side view showing a structure of the developer feeding portion in the Fourth Embodiment.

Figure 19:
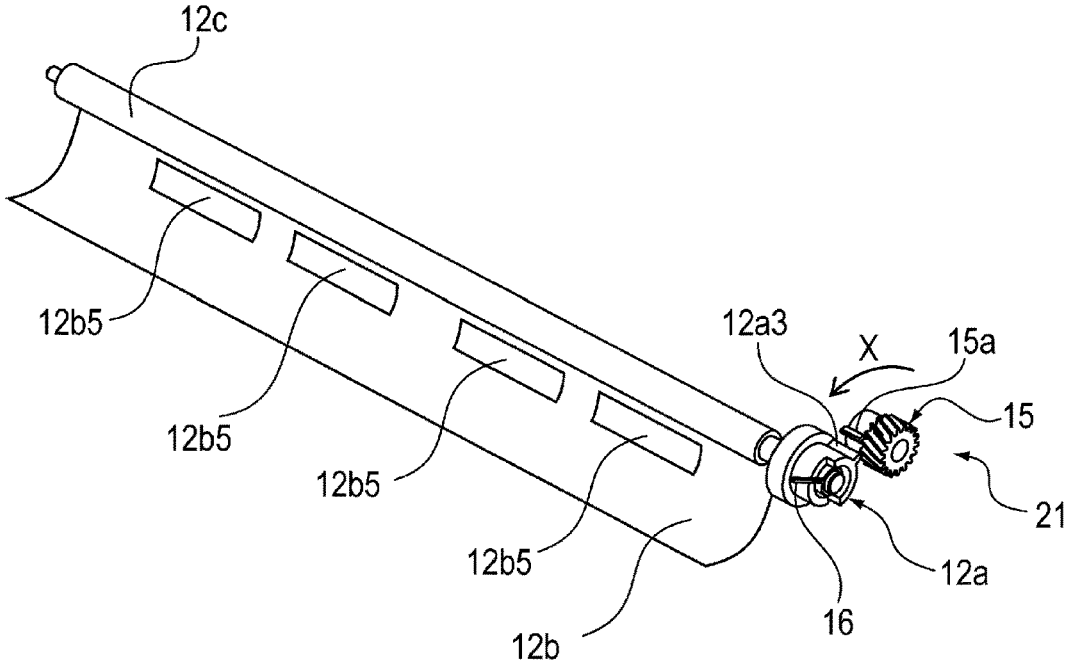

FIG. 19 is a perspective view showing a structure of a developer feeding portion in Fifth Embodiment.

Figure 20:
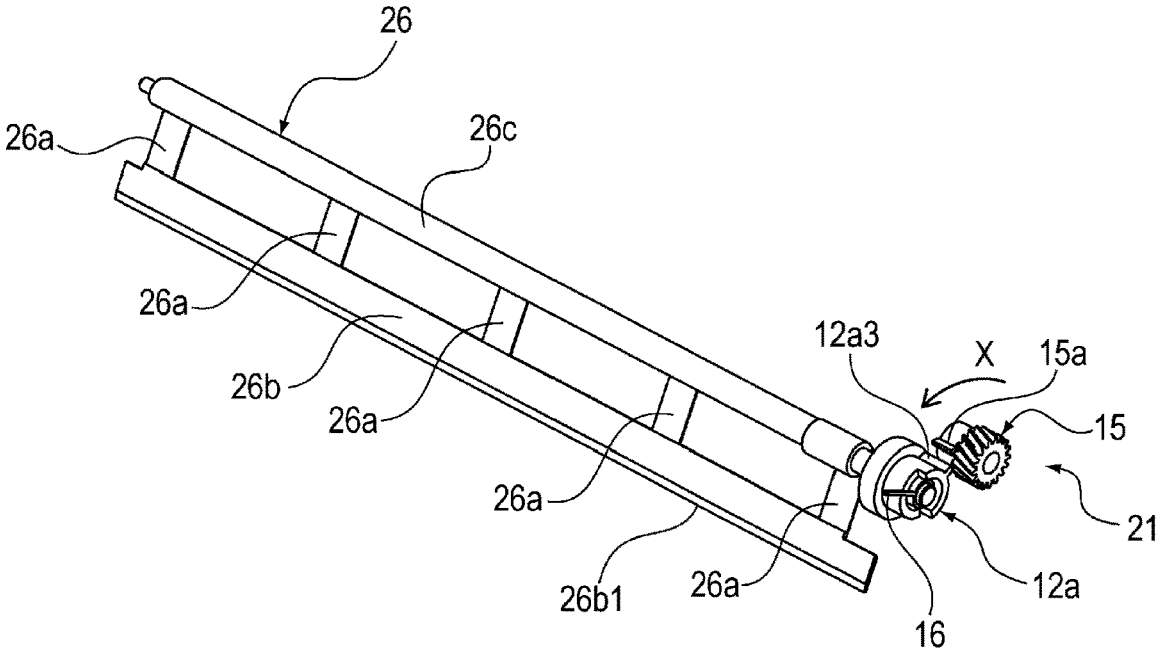

FIG. 20 is a perspective view showing a structure of a developer feeding portion in Sixth Embodiment.

Figure 21:
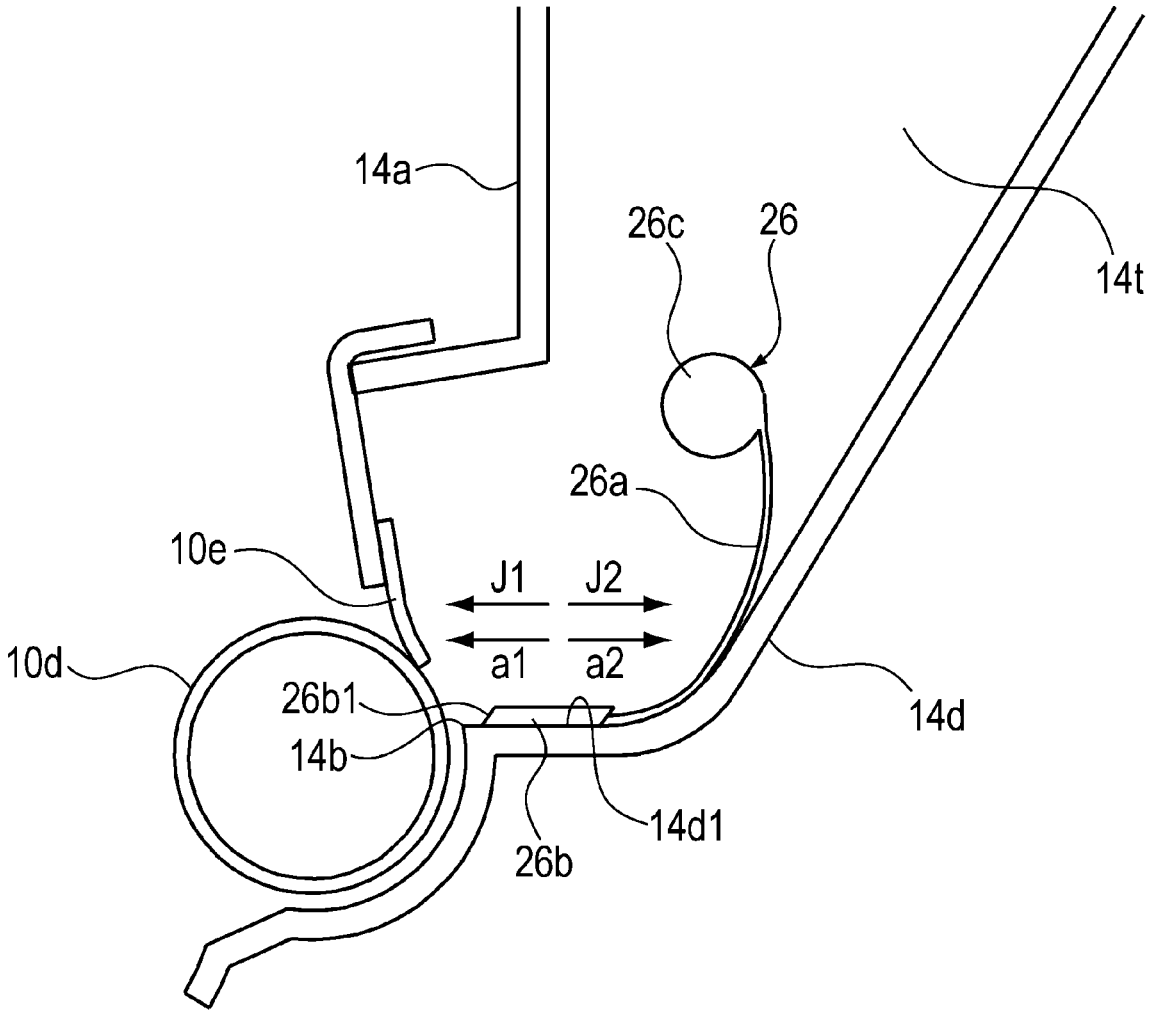

FIG. 21 is a sectional view showing a structure of the developer feeding portion in the Sixth Embodiment.

Figure 22:
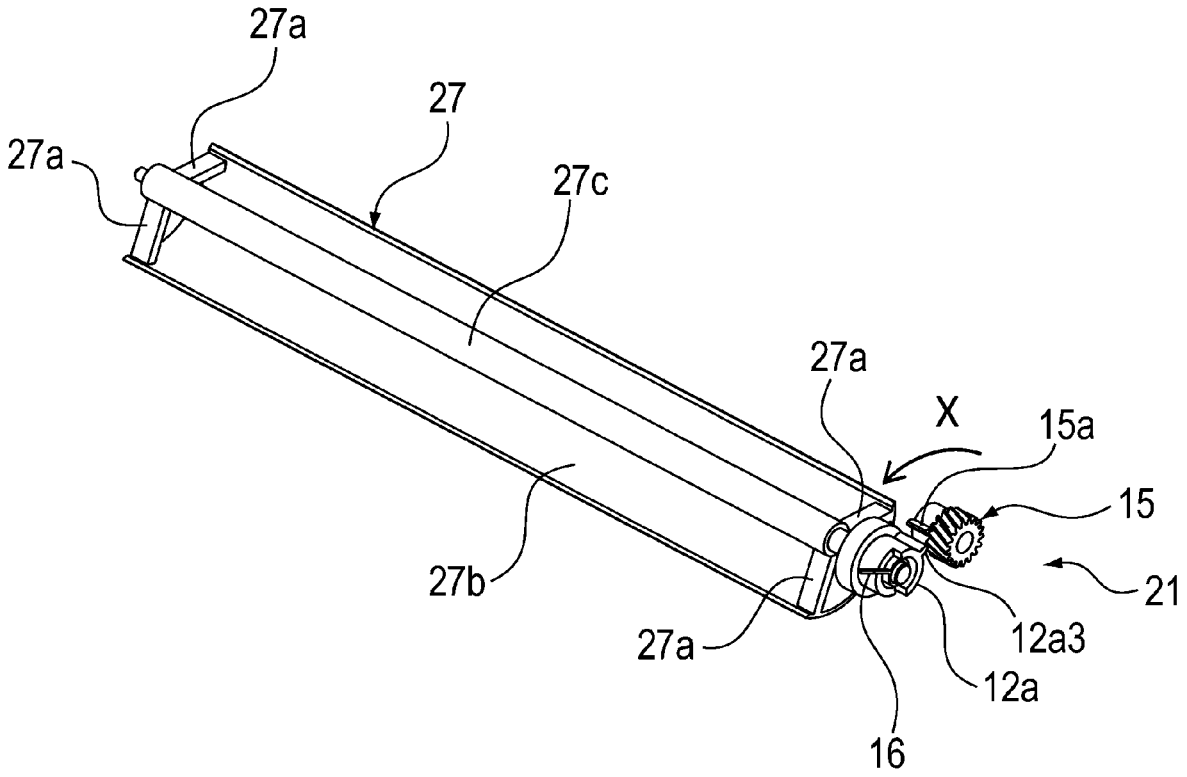

FIG. 22 is a perspective view showing a structure of a developer feeding portion in Seventh Embodiment.

Figure 23:
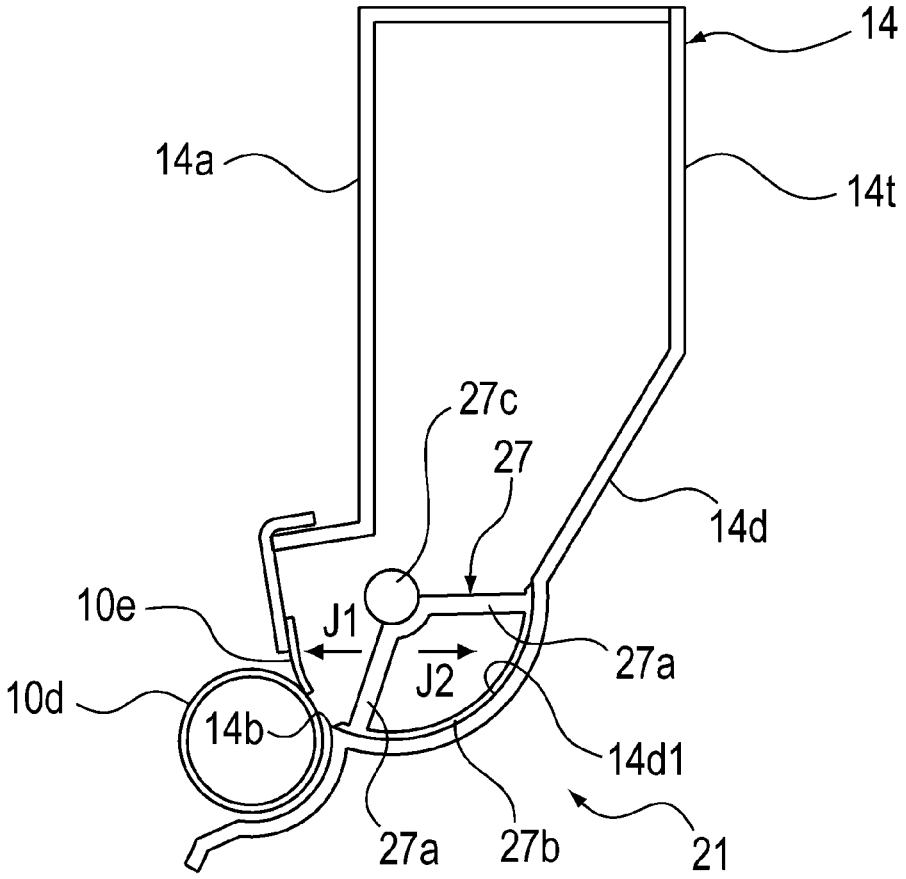

FIG. 23 is a sectional view showing a structure of the developer feeding portion in the Seventh Embodiment.

Figure 24:
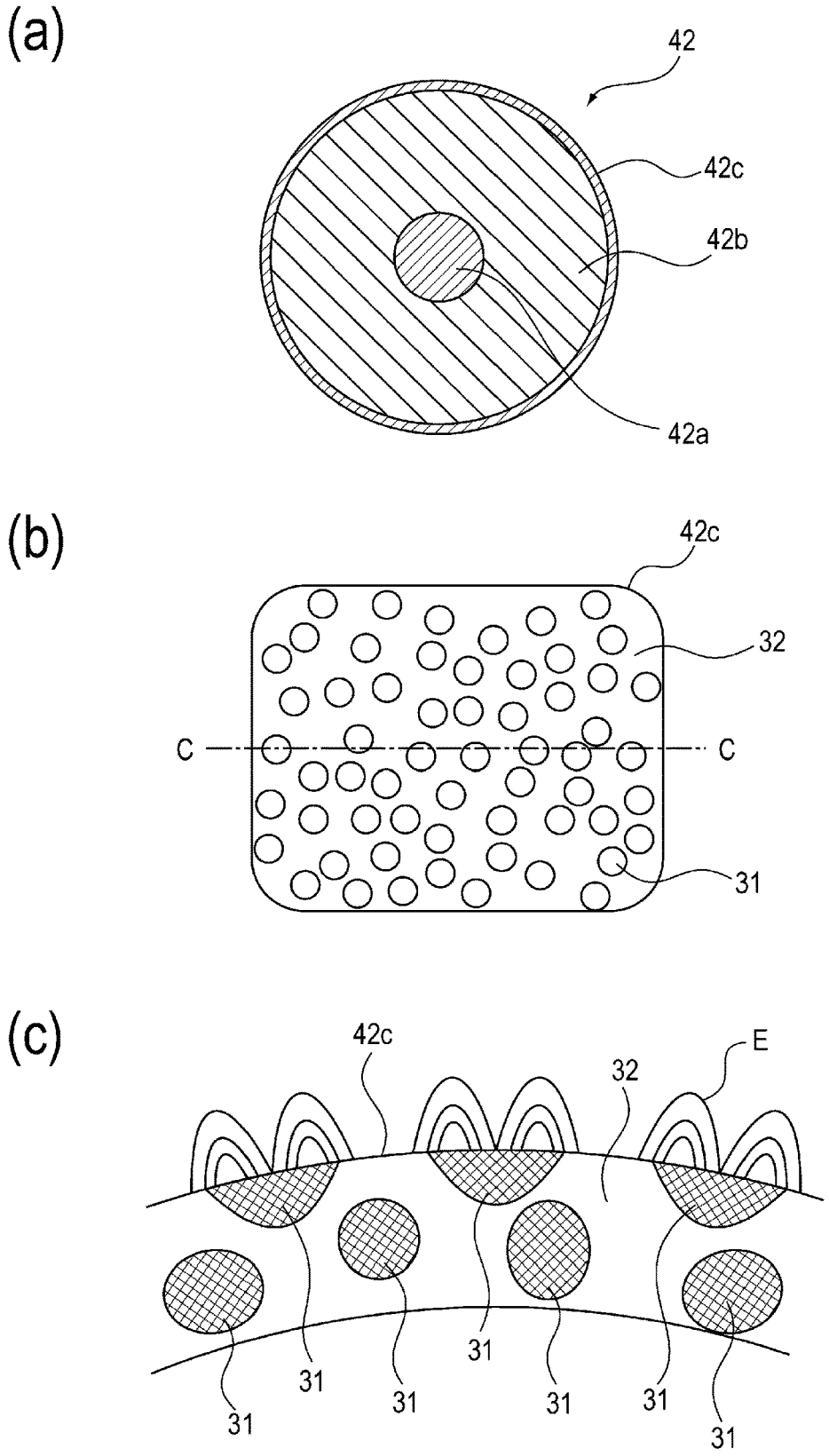

Part (a) of FIG. 24 is a sectional view showing a structure of a developing roller in Eighth Embodiment, part (b) of FIG. 24 is a plan view showing a structure of an outer peripheral surface of the developing roller in the to Eighth Embodiment, and part (c) of FIG. 24 is a sectional view of the outer peripheral surface of the developing roller taken along C-C line of part (b) of FIG. 24.

Figure 25:
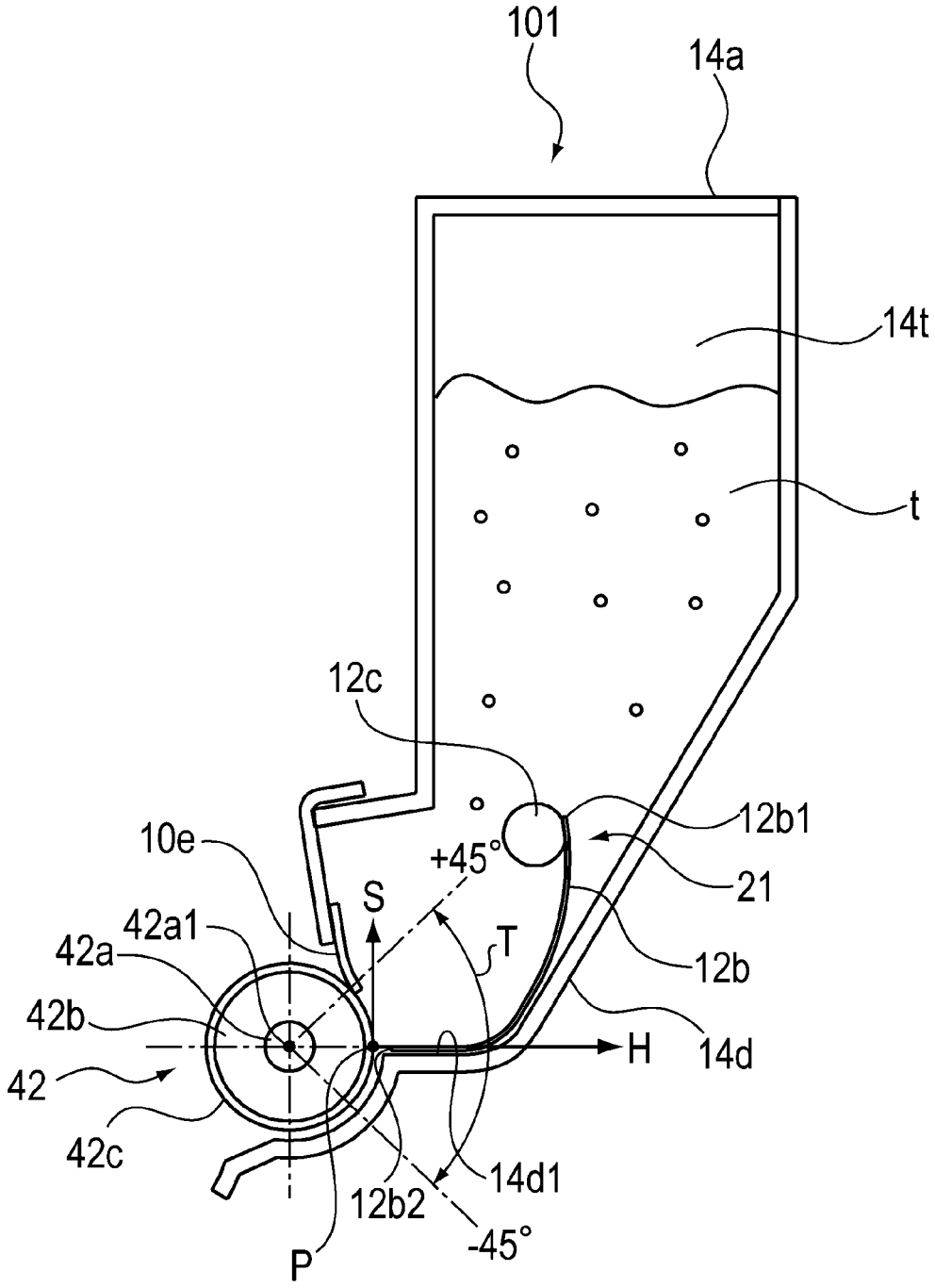

FIG. 25 is a sectional view showing a structure of a developing unit in the Eighth Embodiment.

DESCRIPTION OF EMBODIMENTS

Embodiments of a developer accommodating unit, a cartridge and an image forming apparatus according to the present invention will be specifically described with reference to the drawings. However, as regards dimensions, materials, shapes, relative arrangements and the like of constituent elements described in the following embodiments, the scope of the present invention is not intended to be limited to the following embodiments unless otherwise specified.

In the following description, a longitudinal direction of a cartridge B is an axial direction of a photosensitive drum 7 as an image bearing member. Further, a left-right direction is a direction perpendicular to a feeding direction of a recording material 2. Further, an upper surface of the cartridge B is a surface positioned at an upper portion in a state in which the cartridge B is mounted in an image forming apparatus A main assembly, and a lower surface is a surface positioned at a lower portion in the state.

First Embodiment

First, structures of a developer accommodating unit, the cartridge B and the image forming apparatus A in First Embodiment according to the present invention will be described with reference to FIGS. 1 to 12.

<Image Forming Apparatus>

Figure 1:
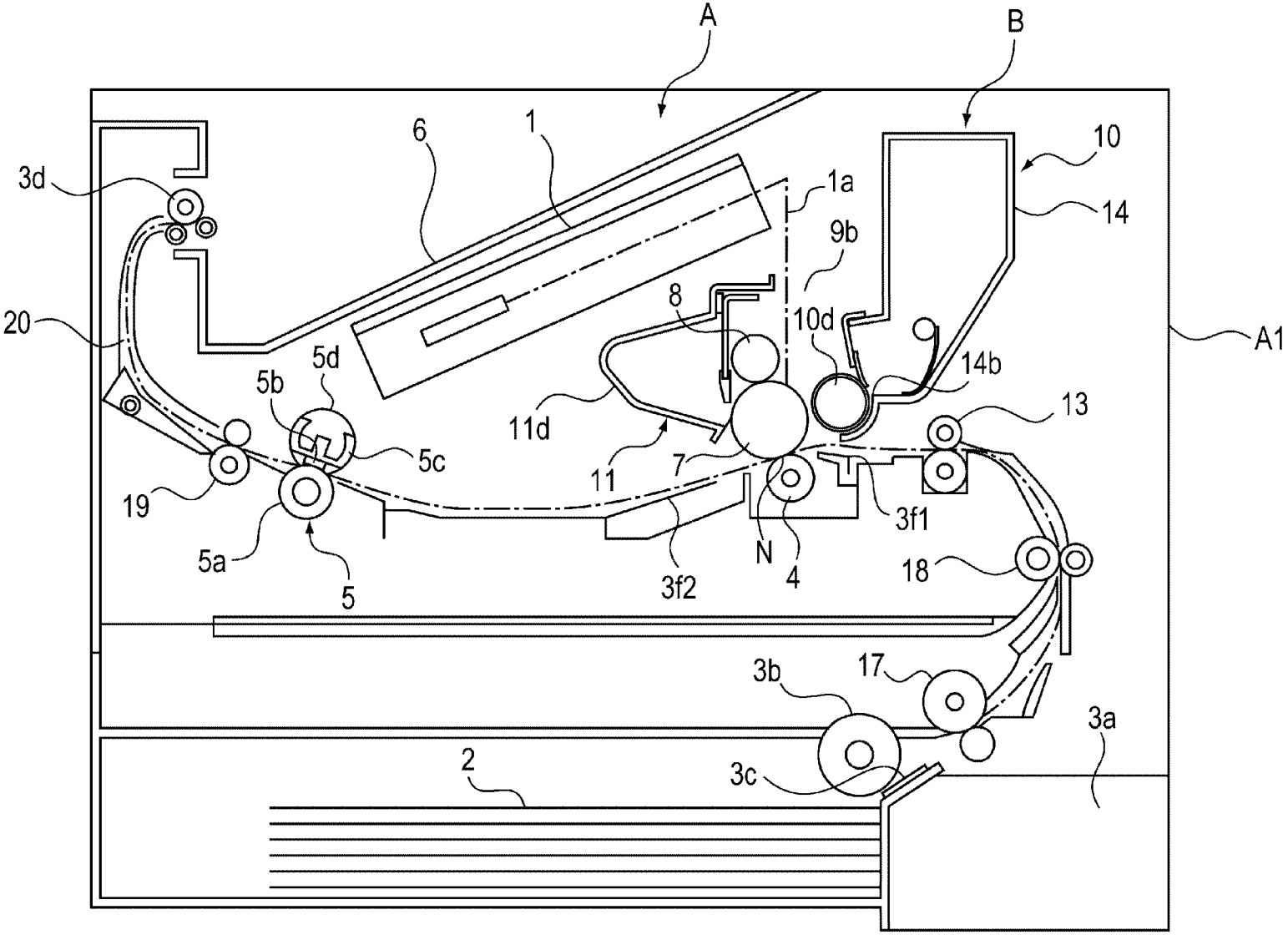
FIG. 1 is a sectional view showing a structure of an image forming apparatus.
Figure 2:
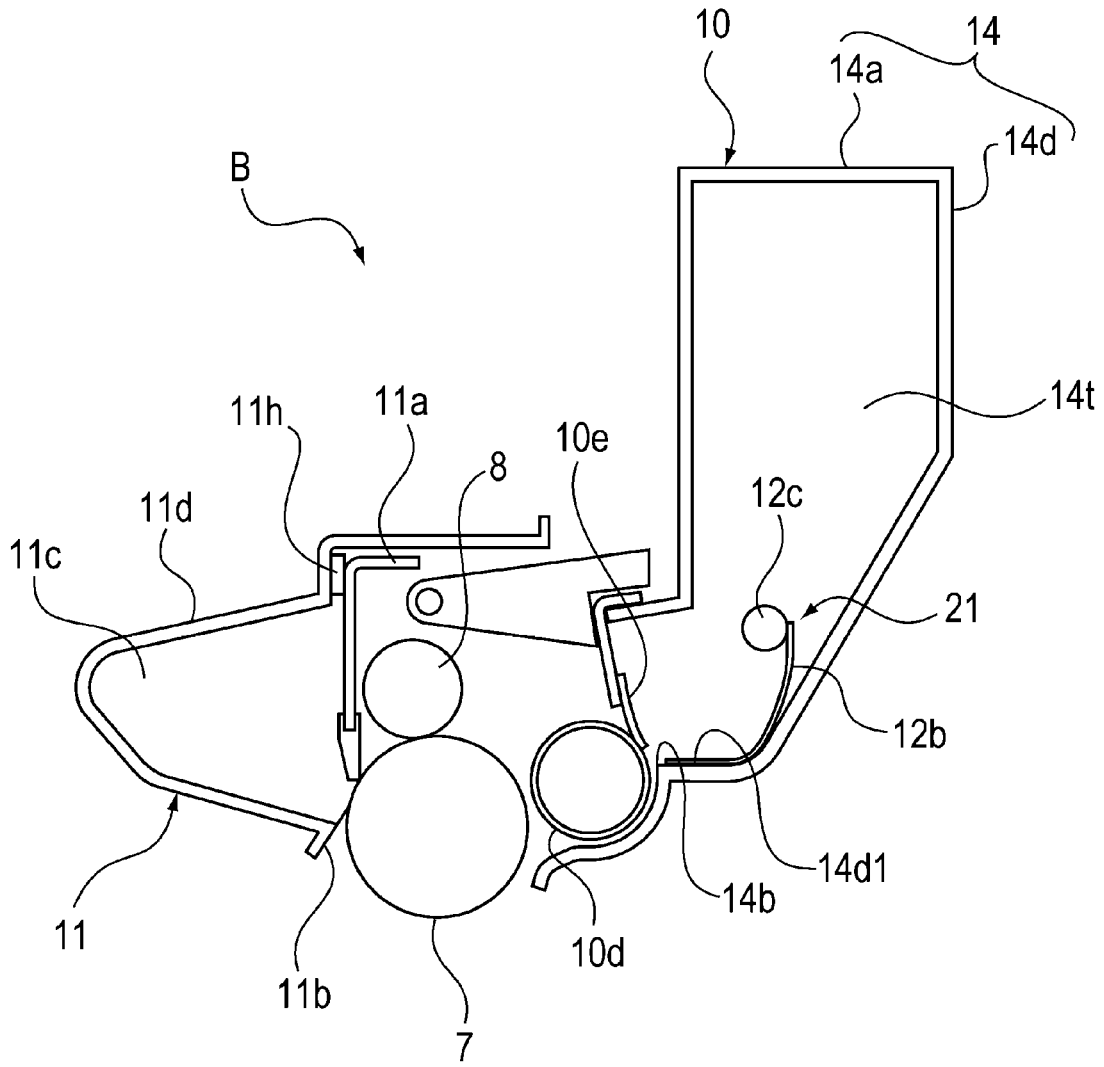
FIG. 2 is a sectional view showing a structure of a cartridge in First Embodiment.
Figure 3:
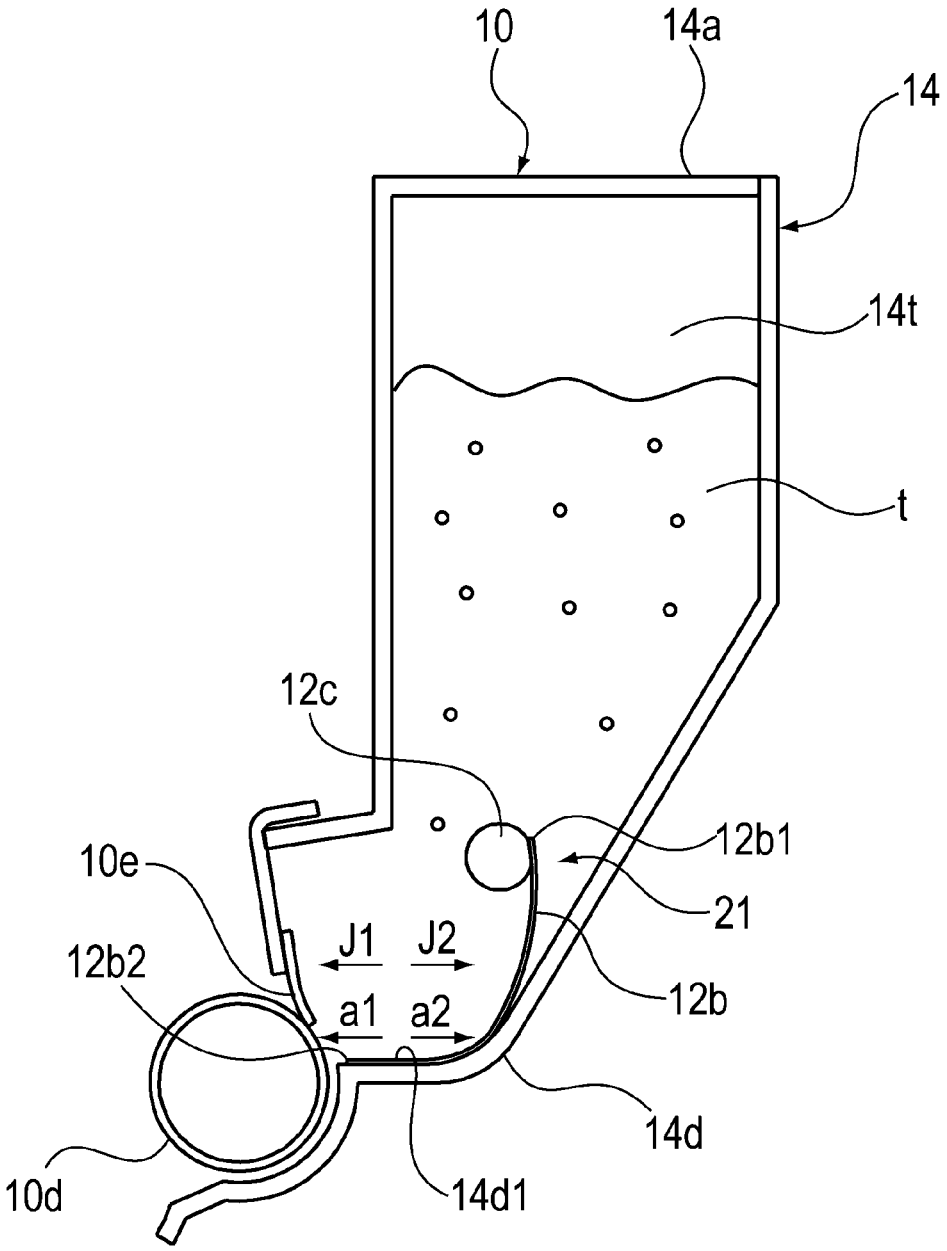
FIG. 3 is a sectional view showing a structure of a developer accommodating unit in the First Embodiment.
Figure 4:
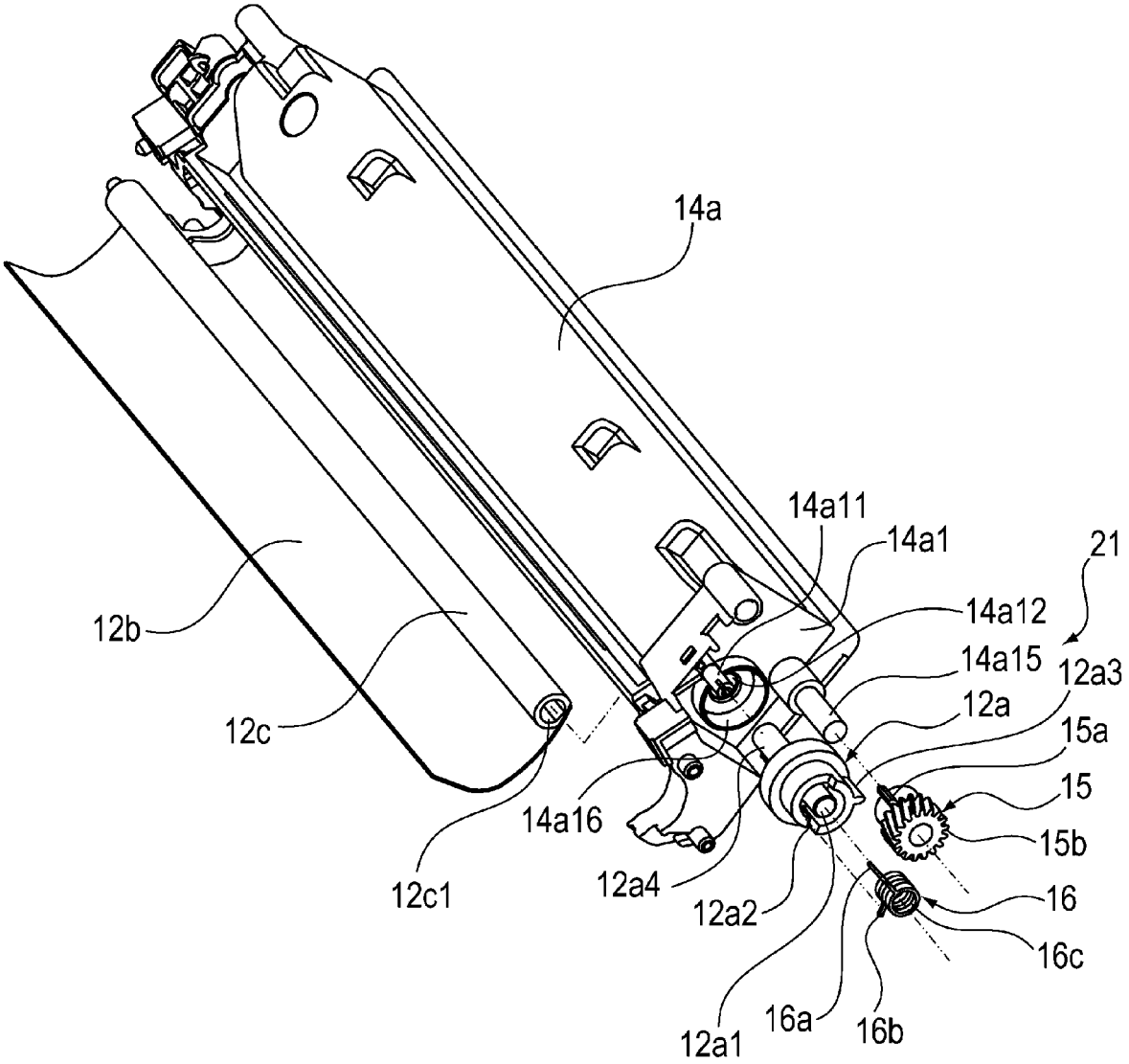
FIG. 4 is an exploded perspective view showing a structure of a developer feeding portion in First Embodiment.

The structure of the image forming apparatus A according to the present invention will be described. FIG. 1 is a sectional view showing a structure of the image forming apparatus A. FIG. 2 is a sectional view showing a structure of a cartridge B in this embodiment. FIG. 3 is a sectional view showing a structure of a developer accommodating unit 10 in this embodiment. FIG. 4 is an exploded perspective view showing a structure of a developer feeding portion 21 in this embodiment.

The image forming apparatus A shown in FIG. 1 is an example of a laser beam printer. The cartridge B is mountable in and dismountable from the image forming apparatus A main assembly. As shown in FIG. 1, the image forming apparatus A for forming an image on the recording material 2 such as paper includes an apparatus main assembly A1 and the cartridge B mountable in and dismountable from the apparatus main assembly A1.

<Cartridge>

Next, the structure of the cartridge B will be described. The cartridge B of this embodiment is an example of a process cartridge including the photosensitive drum 7 which is the image bearing member for bearing a developer image and including at least one image forming process means. At a periphery of the photosensitive drum 7, a charging roller 8 which is a charging means for electrically charging uniformly a surface of the photosensitive drum 7 rotating in the clockwise direction of FIG. 1 is provided. Further, a laser scanner 1 which is an exposure means for irradiating the uniformly charged surface of the photosensitive drum 7 with laser light 1*a* depending on image information is provided.

Further, at the periphery of the photosensitive drum 7, a developing unit 10 as a developer accommodating unit for supplying toner t as a developer to an electrostatic latent image formed by irradiation of the surface of the photosensitive drum 7 with the laser light 1*a* is provided. Further, a transfer roller 4 which is a transfer means for transferring a toner image formed on the surface of the photosensitive drum 7 by development of the electrostatic latent image by the developing unit 10 is provided. Further, a cleaning blade 11*a* which is a cleaning means for removing residual toner remaining on the surface of the photosensitive drum 7 after transfer, and the like member are provided. The cartridge B is constituted by including a drum unit 11 and the developing unit 10 as the developer accommodating unit.

<Drum Unit>

The drum unit 11 is constituted by including the photosensitive drum 7, the charging roller 8, the cleaning blade 11*a*, a removed toner accommodating portion 11*c*, a sheet member 11*b* and the like. The drum unit 11 is formed by a drum frame 11*d*, and the photosensitive drum 7 is rotatably supported by the drum frame 11*d*. The cleaning blade 11*a* is supported by a fixing portion 11*h* provided on the drum frame 11*d* and contacts the surface of the photosensitive drum 7.

By the drum frame 11*d*, the charging roller 8 is rotatably supported. The charging roller 8 contacts the surface of the photosensitive drum 7 and is rotated by rotation of the photosensitive drum 7. The removed toner accommodating portion 11*c* is formed by the drum frame 11*d*. The sheet member 11*b* is supported by the drum frame 11*d* and contacts the surface of the photosensitive drum 7.

<Developer Accommodating Unit>

The developing unit 10 as the developer accommodating unit is constituted by including a developing roller 10*d* as a developer carrying member for carrying the toner t which is the developer, a developing blade l0*e* as a regulating member for regulating a layer thickness of the developer, a developer container 14 and the like. The developer container 14 is formed by a developing frame 14*a* and a cap potion 14*d*. The developing blade l0*e* is supported by the developing frame 14*a*. The developing blade l0*e* is provided opposed to the surface of the developing roller 10*d*.

As shown in FIG. 1, in an attitude in which the cartridge B is mounted in the apparatus main assembly A1 and is used, the developer container 14 is provided with an opening 14*b* at a lower portion thereof with respect to the direction of gravitation. The developing roller 10*d* as the developer carrying member for carrying the toner t as the developer is mounted at the opening 14*b*.

By the developing frame 14*a*, a flexible feeding member 12*b* rotatable about a swing shaft which is swingable is supported. The feeding member 12*b* is constituted so as to be swingable about, as a swing center, an engaging shaft 12*a*4 of a swingable and rotatable member 12*a* rotatably inserted into a communicating opening 14*a*12 which is provided by being penetrated through an outer wall 14*a*1 of the developing frame 14*a* shown in FIG. 4 and of which periphery constitutes a predetermined supporting point.

One end portion of the swing shaft 12*c* with respect to the axial direction of the swing shaft 12*c* is engaged with the swingable and rotatable member 12*a* as a swing transmission member, so that the swing shaft 12*c* and the swingable and rotatable member 12*a* rotates integrally with each other. The other end portion of the swing shaft 12*c* with respect to the axial direction is rotatably shaft-supported by an unshown bearing provided on the developing frame 14.

The feeding member 12*b* is disposed in the developer container 14 and feeds the toner t as the developer in the toner accommodating portion 14*t* (in the developer container) toward the developing roller 10*d* as the developer carrying member. The fixing portion 12*b*1 provided at one end portion of the feeding member 12*b* is supported by the swing shaft 12*c* disposed in parallel to the axial direction of the developing roller 10*d* as the developer carrying member in the toner accommodating portion 14*t* of the developer container 14.

The swingable and rotatable member 12*a* as the swing transmission member transmits a swing force for swinging the swing shaft 12*c*. The feeding member 12*b* is disposed on a lower side of the toner t as the developer and alternately moves in directions of arrows J1 and J2 of FIG. 3, so that the toner t on the feeding member 12*b* is fed in a direction in which the toner t moves toward the developing roller 10*d*.

The feeding member 12*b* is a sheet member which is mounted on the swing shaft 12*c* and which has flexibility. As a material of the feeding member 12*b*, it is possible to use polyethylene terephthalate (PET), polystyrene (PS), polyimide (PI), polyphenylenesulfide (PPS), polyethylene (PE) and polypropylene (PP).

As other materials of the feeding member 12*b*, it is possible to use acrylonitrile butadiene styrene copolymer (ABS), polycarbonate (PC), polyacetal (POM) and the like. In the developer container 14, the toner accommodating portion 14*t* is provided, and in the toner accommodating portion 14*t*, the toner t as the developer is accommodated. As shown in FIG. 1, when the cartridge B is mounted in the apparatus main assembly A1, a part of an inner wall surface 14*d*1 of a bottom of the developer container 14 is positioned substantially horizontally.

The image forming apparatus A forms an electrostatic latent image on the surface of the photosensitive drum 7 by irradiating the uniformly charged surface of the (drum-shaped) photosensitive drum 7 with the laser light 1*a* emitted from the laser scanner 1 on the basis of image information. This electrostatic latent image is developed as a toner image by supplying thereto the toner t as the developer from the developing roller 10*d* provided in the developing unit 10.

On the other hand, at a lower portion of the apparatus main assembly μl a sheet feeding cassette 3*a* accommodating the recording materials 2 is provided. The recording materials 2 fed from the sheet feeding cassette 3*a* by a pick-up roller 3*b* are separated one by one by a separating pad 3*c*. Thereafter, the recording material 2 is conveyed by conveying roller pairs 17 and 18, and a leading end portion of the recording material 2 is abutted against a nip of a registration roller pair 13 which is at rest, so that oblique movement of the recording material 2 is corrected. Thereafter, the recording material 2 is conveyed by the registration roller pair 13 so that the leading end portion of the recording material 2 reaches a transfer nip N in synchronism with timing when a leading end of the toner image carried on the surface of the photosensitive drum 7 reaches the transfer nip N between the photosensitive drum 7 and a transfer roller 4.

The recording material 2 conveyed by the registration roller pair 13 is conveyed to the transfer nip N along a conveying guide 3*f*1. A transfer bias is applied from an unshown transfer bias voltage source to the transfer roller 4. As a result, at the transfer nip N, the toner image carried on the surface of the photosensitive drum 7 is transferred onto the recording material 2. Thereafter, the recording material 2 which is sandwiched between the photosensitive drum 7 and the transfer roller 4 and which carries the toner image thereon is conveyed along a conveying guide 3*f*2 toward a fixing device 5 which is a fixing means.

The fixing device 5 is constituted by including a pressing roller 5*a* and a rotatable fixing member 5*d* formed with a cylindrical sheet rotatably supported by a supporting member 5*c* in which a heater 5*b* is incorporated. The recording material 2 carrying thereon the toner image is heated and pressed again during nip-conveyance by the pressing roller 5*a* and the rotatable fixing member 5*d*, so that the toner image is fixed on the recording material 2. Thereafter, the recording material 2 is conveyed through a reverse conveying path 20 by a conveying roller pair 19 and is discharged onto a discharge tray 6 by a discharging roller 3*d*.

<Image Forming Operation>

Next, an image forming operation by the cartridge B will be described. First, the photosensitive drum 7 including a photosensitive layer at a surface thereof is rotated in the clockwise direction of FIG. 1, and the surface of the photosensitive drum 7 is electrically charged uniformly by applying a charging bias voltage from an unshown charging bias voltage source to the charging roller 8.

The uniformly charged surface of the photosensitive drum 7 is irradiated, through an exposure opening 9*b* provided in a frame of the cartridge B, with the laser light 1*a* comprising a light image emitted from the laser scanner 1 on the basis of the image information. As a result, the electrostatic latent image is formed on the surface of the photosensitive drum 7. This electrostatic latent image is developed as the toner image. The developing unit 10 is constituted as a developing device.

The developing unit 10 rotatably supports the developing roller 10*d* as the developer carrying member for carrying the developer. The developing roller 10*d* rotates in the clockwise direction of FIG. 2. At this time, a toner layer to which triboelectric charges are imparted by the developing blade 10*e* is carried on the surface of the developing roller 10*d*. The toner t is transferred onto the surface of the photosensitive drum 7 depending on the electrostatic latent image formed on the surface of the photosensitive drum 7. As a result, the electrostatic latent image is developed and visualized into the toner image on the surface of the photosensitive drum 7.

Further, to the transfer roller 4, a transfer bias voltage of an opposite polarity to a charge polarity of the toner image is applied, so that the toner image is transferred from the surface of the photosensitive drum 7 onto the recording material 2. The toner t remaining on the surface of the photosensitive drum 7 after the transfer is scraped off by the cleaning blade 11*a* fixed to a fixing portion 11*h* of the drum frame 11*d*. Then, the toner t is scooped by the sheet member 11*b* and is accommodated in the removed toner accommodating portion 11*c*. As a result, residual toner on the surface of the photosensitive drum 7 after the transfer is removed.

<Developer Feeding Portion>

Next, the structure of the developer feeding portion 21 will be described.

Figure 5:
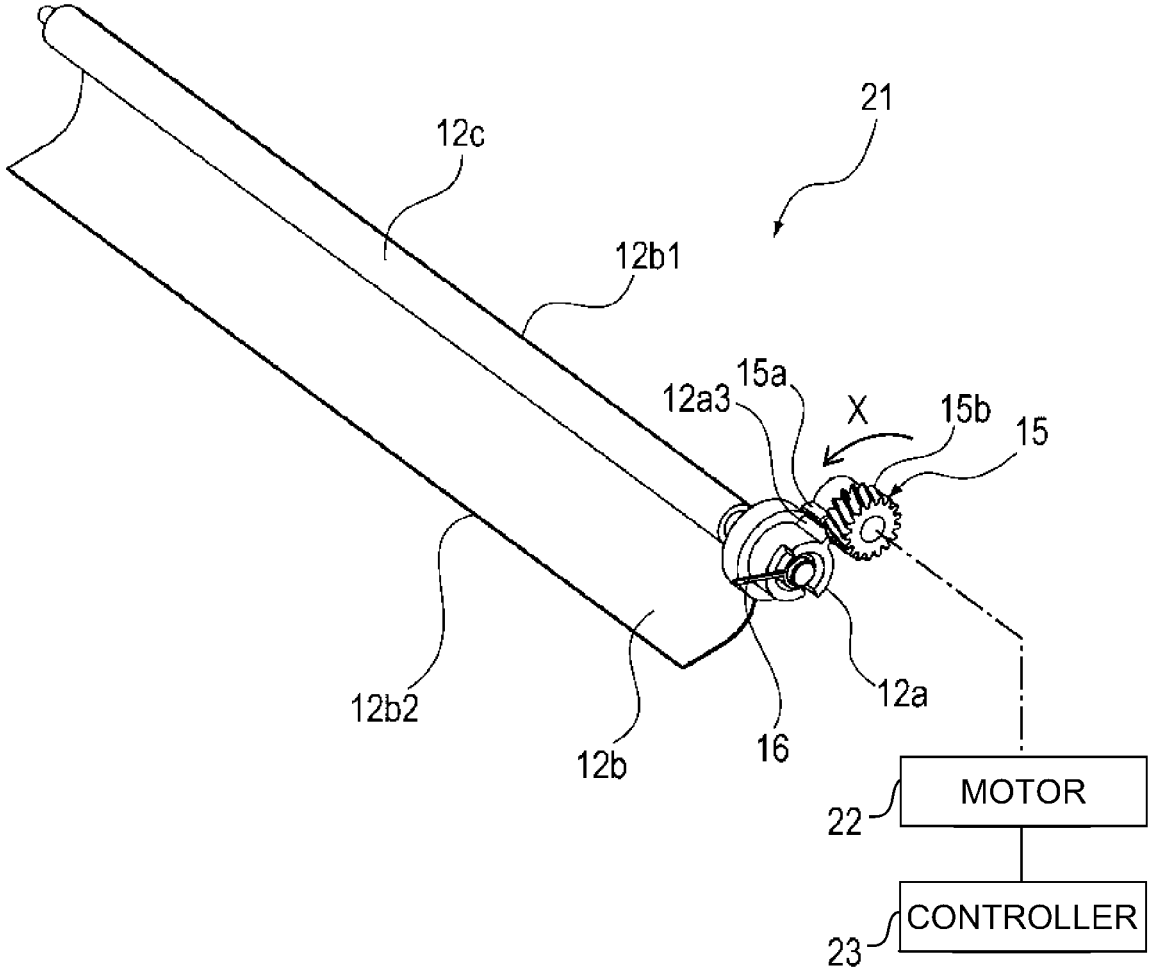
FIG. 5 is a perspective view showing a structure of the developer feeding portion in the First Embodiment.
Figure 6:
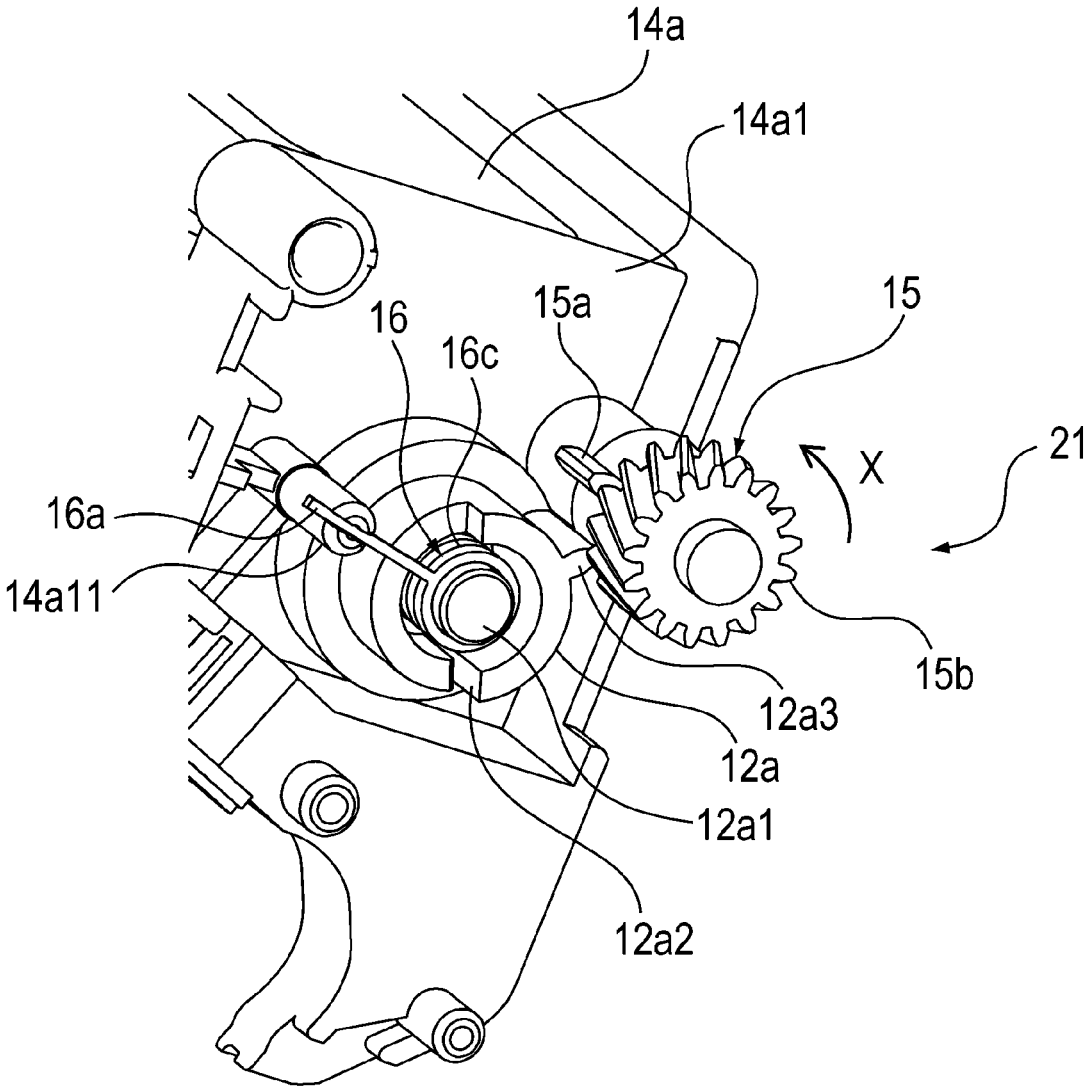
FIG. 6 is a perspective view showing a structure of the developer feeding portion in the First Embodiment.
Figure 7:
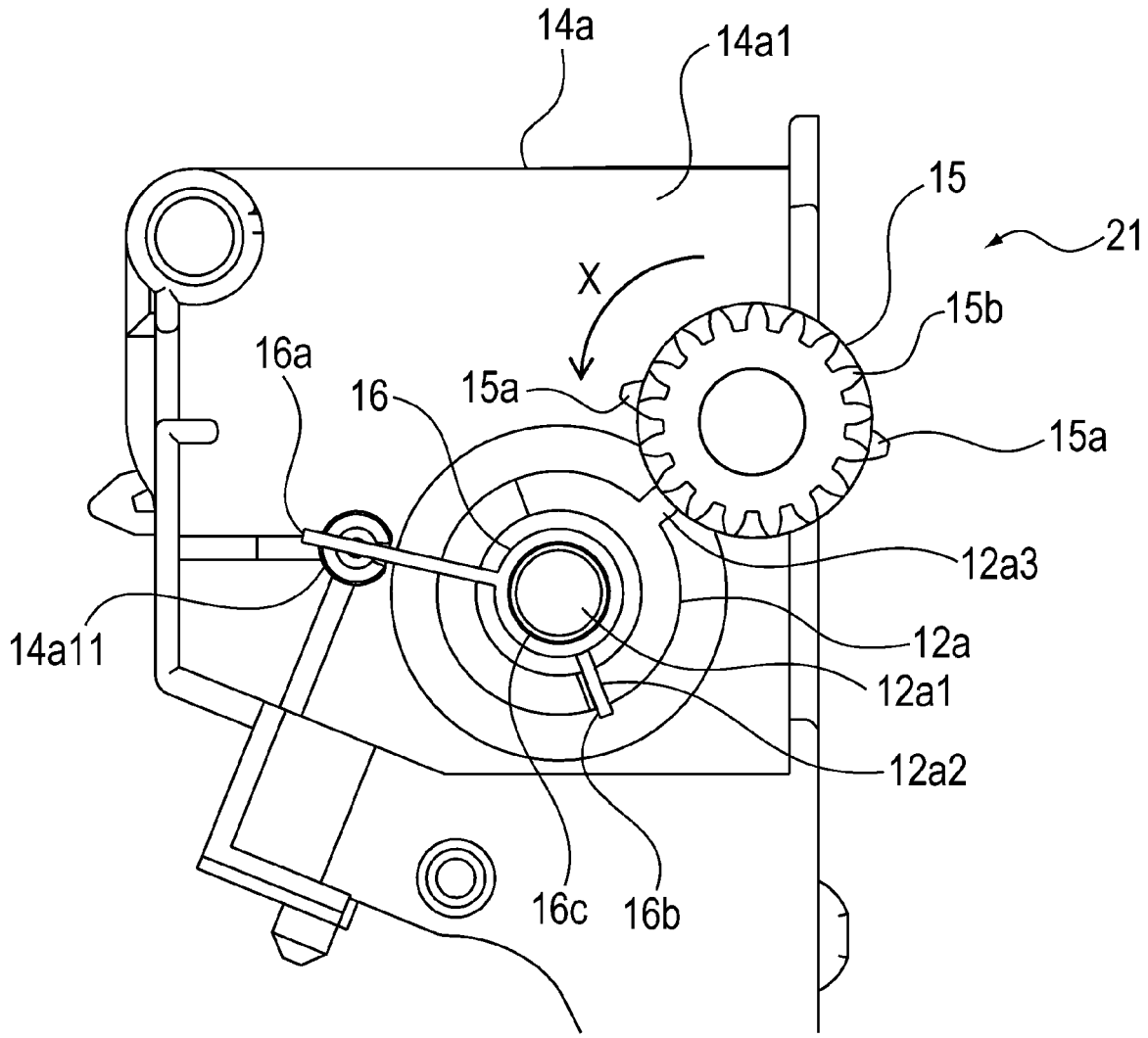
FIG. 7 is a side view showing a structure of the developer feeding portion in the First Embodiment.
Figure 8:
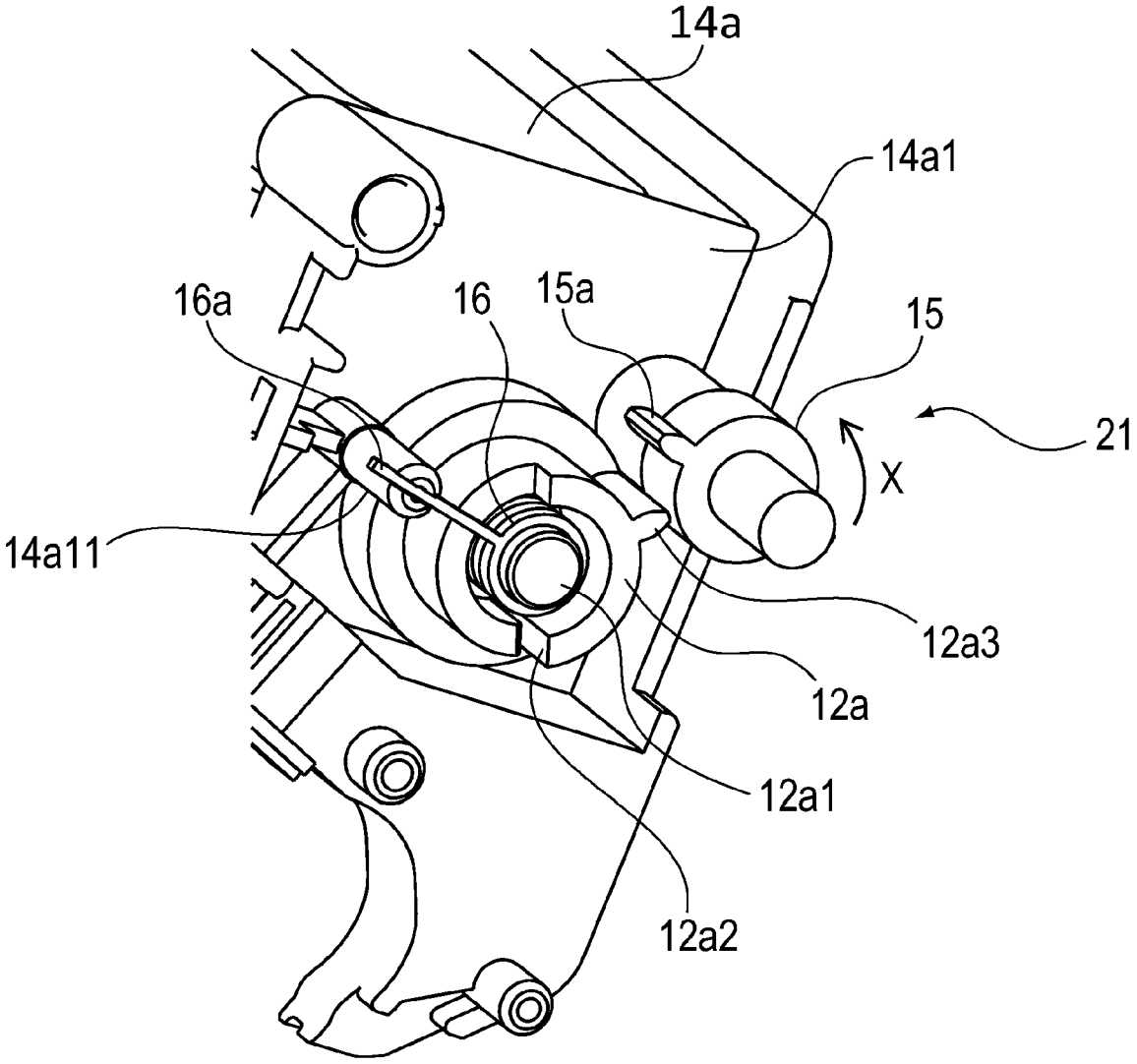
FIG. 8 is a perspective view showing a structure of the developer feeding portion in the First Embodiment.
Figure 9:
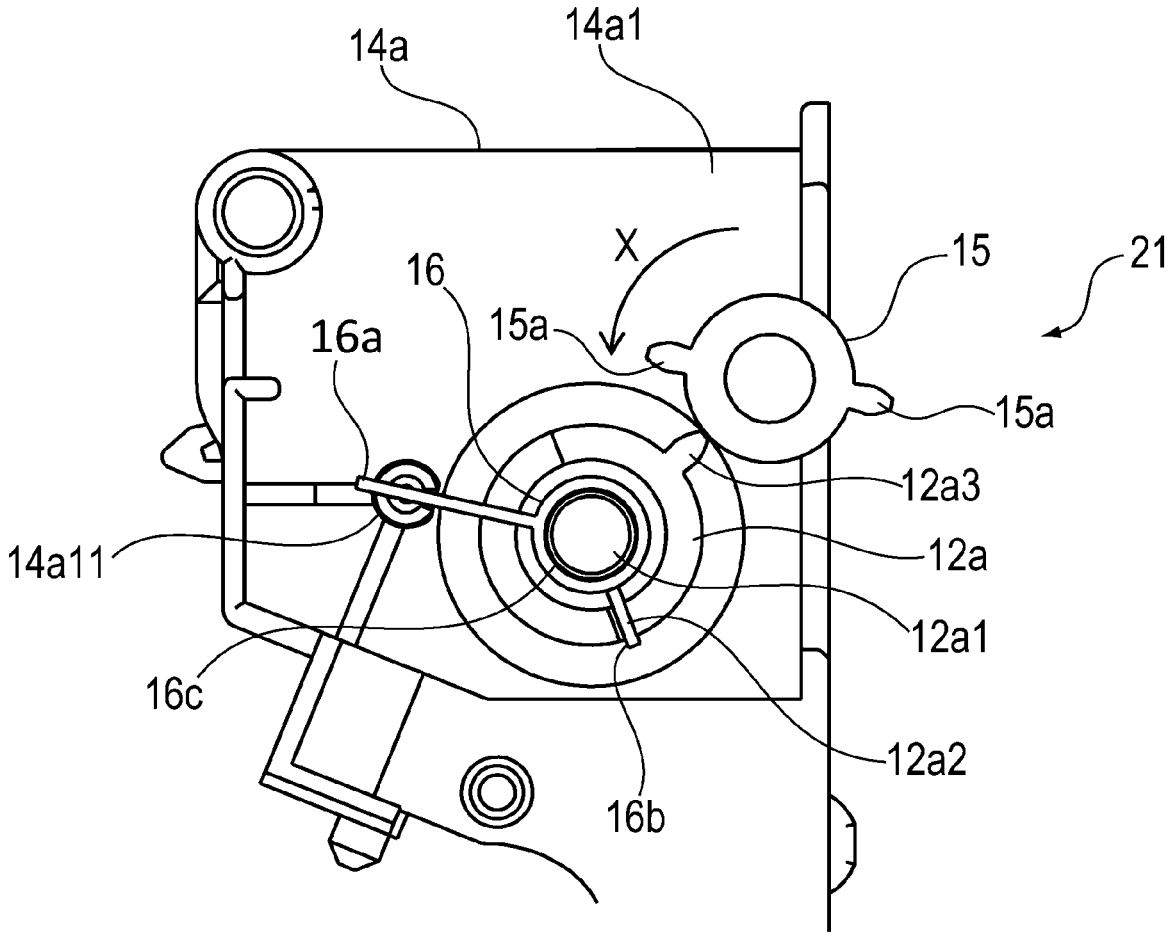
FIG. 9 is a side view showing a structure of the developer feeding portion in the First Embodiment.

FIG. 5 is a perspective view showing a structure of the developer feeding portion 21 in this embodiment. FIG. 6 is a perspective view showing a structure of the developer feeding portion 21 in this embodiment. FIG. 7 is a side view showing a structure of the developer feeding portion 21 in this embodiment. FIG. 8 is a perspective view showing a structure of the developer feeding portion 21 in this embodiment. FIG. 9 is a side view showing a structure of the developer feeding portion 21 in this embodiment. Parts (a), (b) and (c) of FIG. 10 are side view showing a structure of the developer feeding portion 21 in this embodiment. Parts (a), (b) and (c) of FIG. 11 are sectional view showing a structure of the developer feeding portion 21 in this embodiment. FIG. 12 is a sectional view showing a structure of the developing unit 10 in this embodiment.

The developer feeding portion 21 shown in FIGS. 3 and 5 is provided with the developer container 14 including the developing frame 14*a* and the cap portion 14*d*. Further, the developer feeding portion 21 is provided with the feeding member 12*b* which rotates about the swing shaft 12*c* which is rotatably supported by the developer container 14. Further, the developer feeding portion 12 is provided with the swingable and rotatable member 12*a* as the swing transmission member for moving the feeding member 12. Further, the developer feeding portion 21 is provided with a rotatable member 15 as a moving member for moving the swingable and rotatable member 12*a* as the swing transmission member in the clockwise direction of part (b) of FIG. 10 which is a first direction.

Further, the developer feeding portion 21 is constituted by including an urging member 16 or the like comprising a torsion coil spring for urging the swingable and rotatable member 12*a* as the swing transmission member in the counterclockwise direction of part (b) of FIG. 10 which is a second direction opposite to the first direction. As shown in FIG. 6, the rotatable member 15 as the moving member, the swingable and rotatable member 12*a* as the swing transmission member, and the urging member 16 are disposed outside the developer container 14.

<Developer Container>

The structure of the developer container 14 will be described. As shown in FIGS. 2 and 3, an outer contour of the developer container 14 is formed by the developing frame 14*a* and the cap portion 14*d*. As shown in FIGS. 1 and 2, in a state in which the cartridge B is mounted in the apparatus main assembly A1, the feeding member 12*b* is disposed so that at least a part of the sheet member thereof is adjacent to the inner wall surface 14*d*1 of the bottom of the developer container 14.

The feeding member 12*b* is disposed along the inner wall surface 14*d*1 of the bottom of the developer container 14. A swing center of the swing shaft 12*c* of the feeding member 12*b* is disposed above a rotation center of the developing roller 10*d* as the developer carrying member. As shown in FIGS. 6 and 7, the developer container 14 is provided with an outer wall 14*a*1 disposed with respect to a direction perpendicular to a longitudinal direction of the developer container 14.

<Feeding Member>

Next, the structure of the feeding member 12*b* will be described. The feeding member 12*b* which has a sheet shape and flexibility feeds the toner t accommodated in the toner accommodating portion 14*t* while stirring the toner t. The feeding member 12*b* is constituted by a 0.05 mm-thick sheet member made of polyethylene terephthalate (PET). As shown in FIG. 3, the fixing portion 12*b*1 provided at one end portion of the feeding member 12*b* is fixed to the swing shaft 12*c*. As shown in FIG. 5, the swing shaft 12*c* is connected to the swingable and rotatable member 12*a*.

As shown in FIG. 3, a lower surface and a free end portion 12*b*2 of the feeding member 12*b* are disposed so as to extend along the inner wall surface 14*d*1 of the bottom of the cap portion 14*d*. When the swing shaft 12*c* is swung and rotated, the feeding member 12*b* passes between the swing shaft 12*c* and the inner wall surface 14*d*1, of the bottom of the cap portion 14*d*, opposing the swing shaft 12*c* on an underside of the swing shaft 12*c* with respect to the direction of gravitation. The feeding member 12*b* is provided so as to be alternately movable in directions of arrows J1 and J2 of FIG. 3 in the toner accommodating portion 14*t* of the developer container 14.

Next, a driving constitution of the feeding member 12*b* will be described. As shown in FIG. 4, the swing shaft 12*c* to which the feeding member 12*b* is fixed is disposed in the developing frame 14*a* of the developer container 14. On the outer wall 14*a*1 of the developing frame 14*a*, supporting portions 14*a*15 and 14*a*16 are provided. By the supporting portion 14*a*15, the rotatable member 15 is rotatably supported. By the supporting portion 14*a*16, the swingable and rotatable member 12*a* is rotatably supported.

Further, the outer wall 14*a*1 is provided with the communicating opening 14*a*12 which is a through hole for permitting engagement between the swingable and rotatable member 12*a* and the swing shaft 12*c*. Further, on the outer wall 14*a*1, a fixing portion 14*a*11 for fixing a fixing arm 16*a* of the urging member 16 to be mounted in the swingable and rotatable member 12*a* is provided.

<Urging Member>

The urging member 16 is constituted by the torsion coil spring. Two arm portions consisting of a fixed arm 16*a* and a movable arm 16*b* of the urging member 16 are provided at opposite terminal portions, respectively, of a cylindrical portion 16*c* of the urging member 16. The fixed arm 16*a* of the urging member 16 is fixed to the fixing portion 14*a*11 provided on the swingable and rotatable member 12*a*. Then, the cylindrical portion 16*c* of the urging member 16 is engaged with an supported by the outer peripheral surface of the cylindrical supporting portion 12*a*1. Then, the movable arm 16*b* of the urging member 16 is engaged with an engaging portion 12*a*2 provided on the swingable and rotatable member 12.

Further, the swingable and rotatable member 12*a* is provided with a portion-to-be-worked 12*a*3 contacting an acting portion 15*a* of the rotatable member 15. The swingable and rotatable member 12 is rotatably supported by the outer wall 14*a*1 of the developer container 14. A part of the swingable and rotatable member 12*a* engages with the swing shaft 12*c* provided in the toner accommodating portion 14*t* through the communicating opening 14*a*12 which is a through hole provided in the outer wall 14*a*1.

At an end portion of the swing shaft 12*c* on the swingable and rotatable member 12*a* side, an engaging hole 12*c*1 is provided, and an engaging shaft 12*a*4 provided at one end portion of the swingable and rotatable member 12*a* is inserted into the communicating opening 14*a*12 and is engaged in the engaging hole 12*c*1 of the swing shaft 12*c* and thus is connected with the swing shaft 12*c*. As a result, an urging force of the urging member 16 is set so as to act on the swingable and rotatable member 12*a* and the swing shaft 12*c* in a rotational direction.

Here, a position determined by an angle formed by the fixed arm 16*a* and the movable arm 16*b* during no load of the urging member 16 is a neutral position of the swingable and rotatable member 12*a* and the swing shaft 12*c*. When the urging force, with respect to the rotational direction, applied to the swingable and rotatable member 12*a* by the urging member 16 as the urging member is zero, the free end portion 12*b*2 of the feeding member 12*b* is set at a first position 12*b*20 of part (a) of FIG. 11.

<Rotatable Member>

Next, a structure of the rotatable member 15 will be described. As shown in FIGS. 4, 6 and 7, the rotatable member 15 is provided with a gear having two teeth and other omitted teeth as an acting portion 15*a*. Further, the rotatable member 15 is provided with a helical gear 15*b* for receiving a driving force for continuous rotation from an unshown driving force transmission gear provided in the apparatus main assembly A1. Thus, the rotatable member 15 is constituted by a two-stage gear including the acting portion 15*a* consisting of the gear having two teeth and other omitted teeth and by the helical gear 15*b*.

FIGS. 8 to 10 are schematic views from which the helical gear 15*b* of the rotatable member 15 is omitted for convenience of explanation. As shown in FIGS. 8 to 10, the rotatable member 15 is provided with the acting portion 15*a* consisting of the gear having the two teeth which are located at two positions deviated from each other by 180 degrees with respect to a circumferential direction of the rotatable member 15. By rotation of the rotatable member 15, the acting portion 15*a* contacts a portion-to-be-worked 12*a*3 provided on the swingable and rotatable member 12*a* and pushes and rotates the swingable and rotatable member 12*a* in the clockwise direction of part (b) of FIG. 10 against the urging force of the urging member 16.

Further, when the acting portion 15*a* is disconnected from the portion-to-be-worked 12*a*3 by rotation of the rotatable member 15, the swingable and rotatable member 12*a* is rotated in the counterclockwise direction of part (c) of FIG. 10 and is returned to an original position by the urging force of the urging member 16. At this time, by a restoring force of the urging member 16, the swingable and rotatable member 12*a* attenuates while alternately repeating the rotation in the counterclockwise direction of part (c) of FIG. 10 and the rotation in the clockwise direction of part (b) of FIG. 10 and thus is returned to the original position shown in part (a) of FIG. 10. The two acting portions 15*a* provided at the positions where a phase of the rotatable member 15 rotating in an arrow X direction is deviated by 180 degrees alternately contact the portion-to-be-worked 12*a*3 provided on the swingable and rotatable member 12*a*, so that the swingable and rotatable member 12*a* repeats the above-described swing every half rotation of the rotatable member 15.

<Operation of Developer Feeding Portion During Drive Input>

Next, an opening of the developer feeding portion 21 during drive input will be described. A rotational driving force of a motor 22 shown in FIG. 5 which is a driving means provided in the apparatus main assembly A1 is transmitted to the rotatable member 15 as a moving member. The motor 22 is drive-controlled by a controller 23 which is a control means. As a result, the rotatable member 15 is rotated in the arrow X direction of FIG. 10.

As a result, the acting portion 15*a* of the rotatable member 15 moves from a state (position) in which the acting portion 15*a* is spaced from the portion-to-be-worked 12*a*3 of the swingable and rotatable member 12*a* as shown in part (a) of FIG. 10 to a state (position) in which the acting portion 15*a* contacts the portion-to-be-worked 12*a*3 of the swingable and rotatable member 12*a* as shown in part (b) of FIG. 10. Then, the acting portion 15*a* pushes and rotates the swingable and rotatable member 12*a* in the clockwise direction of part (b) of FIG. 10 against the urging force of the urging member 16.

With the rotation of the swingable and rotatable member 12*a* in the clockwise direction of part (b) of FIG. 10, the swing shaft 12*c* fixed to the swingable and rotatable member 12*a* is rotated in the clockwise direction of FIG. 3. As a result, the toner tin the toner accommodating portion 14*t* is fed in an arrow J1 direction of FIG. 3. That is, with rotational movement of the swingable and rotatable member 12*a* as a drive transmission member in the clockwise direction of part (b) of FIG. 10 as a first direction, the feeding member 12*b* moves in the arrow J1 direction of part (b) of FIG. 11 which is a direction in which the feeding member 12*b* approaches the developing roller 10*d* as the developer carrying member.

Specifically, the acting portion 15*a* provided on and projected from the outer peripheral surface of the rotatable member 15 rotating in the arrow X direction of part (b) of FIG. 10 contacts the portion-to-be-worked 12*a*3 provided on and projected from the outer peripheral surface of the swingable and rotatable member 12*a*. Then, the acting portion 15*a* pushes and rotates the swingable and rotatable member 12*a* in the clockwise direction of part (b) of FIG. 10 as the first direction against the urging force of the urging member 16. Then, by the rotation of the swingable and rotatable member 12*a* in the first direction, the feeding member 12*b* is moved in the arrow J1 direction of part (b) of FIG. 11 which is the direction in which the feeding member 12*b* approaches the developing roller 10*d*.

From the state shown in part (b) of FIG. 10, the rotatable member 15 is further rotated in the arrow X direction of part (c) of FIG. 10. Then, the acting portion 15 is separated from the portion-to-be-worked 12*a*3 of the swingable and rotatable member 12*a*, so that the swingable and rotatable member 12*a* is rotated in the counterclockwise direction of part (c) of FIG. 10 by the urging force of the urging member 16.

As a result, the swing shaft 12*c* fixed to the swingable and rotatable member 12*a* is rotated in the counterclockwise direction of FIG. 3. As a result, the feeding member 12*b* fixed to the swing shaft 12*c* is moved in an arrow J2 direction of part (c) of FIG. 11. As a result, the toner tin the toner accommodating portion 14*t* is fed in the arrow J2 direction of FIG. 3.

That is, with rotational movement of the swingable and rotatable member 12*a* as the swing transmission member in the counterclockwise direction of part (c) of FIG. 10 as a second direction, the feeding member 12*b* is moved in the arrow J2 direction of part (c) of FIG. 11 which is a direction in which the feeding member 12*b* is spaced from the developing roller 10*d*. Specifically, the acting portion 15*a* of the rotatable member 15 rotating in the arrow X direction of part (b) of FIG. 10 is disconnected from the portion-to-be-worked 12*a*3 of the swingable and rotatable member 12*a*. Then, by the urging force of the urging member 16, the swingable and rotatable member 12*a* is rotated in the counterclockwise direction of part (c) of FIG. 10 as the second direction opposite to the first direction described above. As a result, the feeding member 12*b* is moved in the direction in which the feeding member 12*b* is moved away from the developing roller 10*d*.

At this time, the urging member 16 carried out attenuation motion by the restoring force of the urging member 16. At this time, the swing shaft 12*c* fixed to the swingable and rotatable member 12*a* repeats the rotation in the counterclockwise direction of FIG. 3 and the rotation in the clockwise direction of FIG. 3 with the attenuation motion of the urging member 16. Then, in a period until the swing of the swing shaft 12*c* converges and stops, the acting portion 15*a* of the rotatable member 15 and the portion-to-be-worked 12*a*3 of the swingable and rotatable member 12*a* are constituted so as not to contact each other. When the rotatable member 15 is further rotates in the arrow X direction of part (c) of FIG. 10, the other acting portion 15*a* deviated in phase from the acting portion 15*a* by 180 degrees contacts the portion-to-be-worked 12*a*3 of the swingable and rotatable member 12*a*, so that the above-described opening is repeated.

<Toner Feeding Operation by Developer Feeding Portion>

Next, a feeding operation of the toner tin the toner accommodating portion 14*t* by the developer feeding portion 21 will be described. Phases of the swingable and rotatable member 12*a* with respect to the rotational direction shown in parts (a) to (c) of FIG. 10 and first to third positions 12*b*20 to 12*b*22 of the free end portion 12*b*2 of the feeding member 12*b* correspond to each other, respectively.

The acting portion 15*a* of the rotatable member 15 rotating in the arrow X direction of parts (a) to (c) of FIG. 10 contacts the portion-to-be-worked 12*a*3 of the swingable and rotatable member 12*a*. As shown part (b) of FIG. 10, the acting portion 15*a* of rotatable member 15 contacts the portion-to-be-worked 12*a*3 of the swingable and rotatable member 12 and pushes and rotates the swingable and rotatable member 12*a* in the clockwise direction of part (b) of FIG. 10 against the urging force of the urging member 16. At this time, the free end portion 12*b*2 of the feeding member 12 rotating integrally with the swingable and rotatable member 12*a* via the swing shaft 12*c* moves from the first position 12*b*20 shown in part (a) of FIG. 11 to the second position 12*b*21 shown in part (b) of FIG. 11.

When the rotatable member 15 is rotationally driven further in the arrow X direction of part (b) of FIG. 10, the acting portion 15*a* of the rotatable member 15 is disconnected from the portion-to-be-worked 12*a*3 of the swingable and rotatable member 12*a*. As a result, the swingable and rotatable member 12*a* is rotated in the counterclockwise direction of part (c) of FIG. 11 by the urging force of the urging member 16. At this time, the free end portion 12*b*2 of the feeding member 12*b* moves from the second position 12*b*21 shown in part (b) of FIG. 11 to the third position 12*b*22 shown in part (c) of FIG. 11. Thereafter, the urging force of the urging member 16 released by the restoring force while alternately repeating the rotation of the swingable and rotatable member 12*a* in the clockwise direction and the counterclockwise direction of part (c) of FIG. 10 is attenuated.

The rotational driving force from the motor 22 shown in FIG. 5 which is the driving means rotated in the apparatus main assembly A1 is transmitted to the rotatable member 15, so that the rotatable member 15 is rotated in the arrow X direction of part (a) of FIG. 10. Then, as shown in part (b) of FIG. 10, the acting portion 15*a* of the rotatable member 15 contacts the portion-to-be-worked 12*a*3 of the swingable and rotatable member 12*a* and pushes and rotates the swingable and rotatable member 12*a* in the clockwise direction of part (b) of FIG. 10 against the urging force of the urging member 16.

As a result, the swingable and rotatable member 12*a* is rotated in the clockwise direction of part (b) of FIG. 10, so that the swing shaft 12*c* is rotated integrally with the swingable and rotatable member 12*a* in the clockwise direction of FIG. 3. As a result, the free end portion 12*b*2 of the feeding member 12*b* moves in the arrow J1 direction from the first position 12*b*20 shown in part (a) of FIG. 11 to the second position 12*b*21 shown in part (b) of FIG. 11. At this time, the rotatable member 15 pushes and rotates the swingable and rotatable member 12*a* in the clockwise direction of part (b) of FIG. 10 against the urging force of the urging member 16, and applies first maximum acceleration a1 to the feeding member 12*a* in the arrow J1 direction of part (b) of FIG. 11.

By this operation, the free end portion 12*b*2 of the feeding member 12 is moved from the first position 12*b*20 as the neutral position shown in part (a) of FIG. 11 to the second position 12*b*21 shown in part (b) of FIG. 11. At this time, at least a part of the toner t on the feeding member 12*a* moves in the arrow J1 direction of part (b) of FIG. 11 in synchronism with the feeding member 12*b* without sliding on the feeding member 12*b*.

Thereafter, with further rotational operation of the rotatable member 15 in the arrow X direction of part (b) of FIG. 10, the acting portion 15*a* of the rotatable member 15 is disconnected from the portion-to-be-worked 12*a*3 of the swingable and rotatable member 12*a*. As a result, the swingable and rotatable member 12*a* is rotated in the counterclockwise direction of part (c) of FIG. 10 by the urging force of the urging member 16. As a result, the swing shaft 12*c* fixed to the swingable and rotatable member 12*a* is rotated in the counterclockwise direction of FIG. 3. As a result, the feeding member 12*b* is moved in the arrow J2 direction of part (c) of FIG. 11.

That is, by the urging force of the urging member 16, second maximum acceleration a1 is applied to the feeding member 12*b* in the arrow J2 direction of part (c) of FIG. 11 via the swingable and rotatable member 12*a* and the swing shaft 12*c*. Also to the toner t on the feeding member 12*b* in the toner accommodating portion 14*t*, the second maximum acceleration a2 is applied in the arrow J2 direction of part (c) of FIG. 11.

As a result, the free end portion 12*b*2 of the feeding member 12*b* passes from the second position 12*b*21 shown in part (b) of FIG. 11 through the first position 12*b*20 shown in part (a) of FIG. 11 and moves to the third position 12*b*20 shown in part (c) of FIG. 11. At this time, the toner ton t on the feeding member 12*b* in the toner accommodating portion 14*t* slides on the feeding member 12. The urging member 16 also has a function as a deceleration means. That is, the engaging portion 12*a*2 of the swingable and rotatable member 12*b* shown in FIG. 4 is alternately subjected to the urging forces, as the restoring force of the urging member 16, in the counterclockwise direction and the clockwise direction of part (c) of FIG. 10.

The feeding member 12*b* is subjected to a frictional force between itself and the inner wall surface of the toner accommodating portion 14*t* and to reaction (force) from the toner tin the toner accommodating portion 14*t*. As a result, vibration of the feeding member 12*b* attenuates in synchronism with the attenuation motion of the urging member 16, and then the free end portion 12*b*2 of the feeding member 12*b* is returned to the first position 12*b*20 shown in part (a) of FIG. 11.

<Behavior of Toner Ton Feeding Member 12*a* and Acceleration Setting Condition of Developer Feeding Portion 21>

Next, the feeding member 12*b*, behavior of the toner t on the feeding member 12*b*, and an acceleration setting condition of the developer feeding portion will be described.

<Position of Free End Portion 12*b*2 of Feeding Member 12*b* and Definition of Acceleration of Feeding Member 12*b*>

First, the position of the free end portion 12*b*2 and the feeding member 12*b* and definition of the acceleration of the feeding member 12*b* will be described.

As shown in part (a) of FIG. 10, a state in which the acting portion 15*a* of the rotatable member 15 does not contact the portion-to-be-worked 12*a*3 of the swingable and rotatable member 12*a* will be considered. At this time, the swingable and rotatable member 12*a* is in a natural state in which the urging force 16 does not act on the swingable and rotatable member 12*a* in the rotational direction of the swingable and rotatable member 12*a*. At this time, the free end portion 12*b*2 of the feeding member 12*b* is set at the first position 12*b*20 shown in part (a) of FIG. 11.

On the other hand, as shown in part (b) of FIG. 10, the rotatable member 15 is rotated in the arrow X direction of part (b) of FIG. 10, so that the acting portion 15*a* of the rotatable member 15 contacts the portion-to-be-worked 12*a*3 of the swingable and rotatable member 12*a*. Then, the rotatable member 15 pushes and rotates the swingable and rotatable member 12*a* in the clockwise direction of part (b) of FIG. 10 against the urging force of the urging member 16. Further, a position where the free end portion 12*b*2 of the feeding member 12*b* is most moved in the arrow J1 direction of part (b) of FIG. 11 is defined as the second position 12*b*21. At this time, a maximum of the acceleration when the feeding member 12*b* moves in the arrow J1 direction of part (b) of FIG. 11 is defined as the maximum acceleration a1.

Then, the rotatable member 15 is further rotated in the arrow X direction of part (b) of FIG. 10, the acting portion 15*a* of the rotatable member 15 is disconnected from the portion-to-be-worked 12*a*3 of the swingable and rotatable member 12*a*. At this time, the swingable and rotatable member 12*a* is rotated in the counterclockwise direction of part (c) of FIG. 10 by the urging force of the urging member 16. At this time, a position where the free end portion 12*b*2 of the feeding member 12*b* is most moved in the arrow J2 direction of part (c) of FIG. 11 is defined as the third position 12*b*22. At this time, a maximum of the acceleration when the feeding member 12*b* moves in the arrow J2 direction of part (c) of FIG. 11 is defined as the second maximum acceleration a2.

<Acceleration Setting Condition of Developer Feeding Portion 21>

Next, the acceleration setting condition of the developer feeding portion 21 will be described. The second maximum acceleration a2 of the feeding member 12 shown in part (c) of FIG. 11 is set at acceleration, by which the toner t on the feeding member 12*b* in the toner accommodating portion 14*t* slides on the feeding member 12*b*, by adjusting the urging force of the urging member 16.

Next, the first maximum acceleration a1 of the feeding member 12*b* is set at a value smaller than the second maximum acceleration a2 by adjusting the number of rotations (turns) of the rotatable member 15. That is, the rotatable member 15 as the moving member rotates and acts on the swingable and rotatable member 12*a* as the swing transmission member, so that the first maximum acceleration a1 and the second maximum acceleration a2 are set by the number of rotations of the rotatable member 15 and the urging force of the urging member 16, respectively.

<Condition in which Toner t on the Feeding Member 12*b* in Toner Accommodating Portion 14*t* Slides on Feeding Member 12*b*>

Next, a condition in which the toner t on the feeding member 12*b* in the toner accommodating portion 14*t* slides on the feeding member 12*b* will be described. The condition in which the toner t on the feeding member 12*b* in the toner accommodating portion 14*t* slides on the feeding member 12*b* will be considered. Here, coefficient of static friction between the surface of the feeding member 12*b* and the toner t is μ0. The acceleration of gravity is g. The product of the coefficient of static friction (μ0) and the acceleration of gravity (g) is "μ0×g".

The condition in which the toner t on the feeding member 12*b* in the toner accommodating portion 14*t* slides on the feeding member 12*b* will be considered. When the feeding member 12*b* is moved at acceleration "μ0×g" or more in a state in which the toner t is placed on the feeding member 12*b* disposed on a horizontal surface, the toner t on the feeding member 12*b* in the toner accommodating portion 14*t* slides on the feeding member 12*b*.

<Relationship Among First Maximum Acceleration a1, Second Maximum Acceleration a2 and Acceleration "μ0×g" of Feeding Member 12*b* when Toner t Slides on Feeding Member 12*b*, and Feeding Property of Toner t>

Next, the first maximum acceleration a1 of the feeding member 12*b* shown in part (b) of FIG. 11 and the second maximum acceleration a1 of the feeding member 12*b* shown in part (c) of FIG. 11 will be considered. Further, the acceleration "μ0×g" of the feeding member 12*b* when the toner t slides on the feeding member 12*b* will be considered. Then, a relationship among these factors and the feeding property of the toner t will be described.

<Acceleration Setting Condition of Feeding Member 12*b* Capable of Feeding Toner t>

Next, an acceleration setting condition of the feeding member 12*b* capable of feeding the toner t will be described. The first maximum acceleration a1 of the feeding member 12*b* shown in part (b) of FIG. 11 will be considered. Further, the second maximum acceleration a2 of the feeding member 12*b* shown in part (c) of FIG. 11 will be considered. Further, the acceleration, "μ0×g" of the feeding member 12*b* when the toner t slides on the feeding member 12*b* will be considered. The case where the relationships among these factors satisfies the following symbolic formula 1 will be considered.

(Symbolic Formula 1)

"&MY0×g"<a1<a2

At this time, the case where the feeding member 12*b* is moved at the first maximum acceleration a1 in the arrow J1 direction of part (b) of FIG. 11 and is moved at the second maximum acceleration a2 in the arrow J2 direction of part (c) of FIG. 11 will be considered. At that time, when the feeding member 12*b* is moved at the second maximum acceleration a2 in the arrow J2 direction of part (c) of FIG. 11, the toner t sliding on the feeding member 12*b* relatively moves on the feeding member 12*b* in the arrow J1 direction of part (b) of FIG. 11. The arrow J1 direction of part (b) of FIG. 11 is a direction in which the feeding member 12*b* feeds the toner tin the toner accommodating portion 14*t* toward the developing roller 10*d*.

The toner t on the feeding member 12*b* moves on the feeding member 12*b* not only in the arrow J1 direction of part (b) of FIG. 11 but also in the arrow J2 direction of part (c) of FIG. 11. In this case, the first maximum acceleration a1 in the arrow J1 direction of part (b) of FIG. 11 and the second maximum acceleration a2 in the arrow J2 direction of part (c) of FIG. 11 are set to satisfy {a1<a2} as represented by the above-described symbolic formula 1.

That is, the first maximum acceleration a1 in the arrow J1 direction of part (b) of FIG. 11 which is the direction in which the toner t approaches the developing roller 10*d* as the developer carrying member will be considered. Further, the second maximum acceleration a2 in the arrow j2 direction of part (c) of FIG. 11 which is the direction in which the feeding member 12*b* moves away from the developing roller 10*d* will be considered. At this time, setting is made so that the first maximum acceleration a1 is smaller than the second maximum acceleration a2.

Here, a distance, in which the toner t slides on the feeding member 12*b*, which is a movement distance of the toner t relative to the feeding member 12*b* will be considered. Compared with a distance in which the toner t slides when the feeding member 12*b* is moved in the arrow J1 direction of part (b) of FIG. 11, a distance in which the toner t slides when the feeding member 12*b* is moved in the arrow J2 direction of part (c) of FIG. 11 is long.

As shown in the above-described symbolic formula 1, in the case where the relationship between respective pieces of the acceleration is set, these pieces of the acceleration are applied repetitively to the feeding member 12*b*. As a result, movement of the toner t on the feeding member 12*b* in the arrow J1 direction of part (b) of FIG. 11 which is the direction in which the toner t approaches the developing roller 10*d* can be easily realized.

<Acceleration Setting Condition of Feeding Member 12*b* in which Feeding Amount of Toner t Increases>

Next, an acceleration setting condition of the feeding member 12*b* in which the feeding amount of the toner t increases will be described. A relationship among the first maximum acceleration a1, the second maximum acceleration a2 and the acceleration "μ0×g" of the feeding member 12*b* when the toner t slides on the feeding member 12*b* is set at a condition satisfying the following symbolic formula 2.

(Symbolic Formula 2)

a1<"μ0×g"<a2

At this time, when the feeding member 12*b* is moved in the arrow J1 direction of part (b) of FIG. 11, the first maximum acceleration a1 of the feeding member 12*b* shown in part (b) of FIG. 11 is smaller than the acceleration "μ0×g"

of the feeding member 12*b* when the toner t slides on the feeding member 12*b*. For this reason, the toner t is not moved on the feeding member 12*b* disposed on the horizontal surface in the arrow J2 direction relative to the feeding member 12*b*.

Further, when the feeding member 12*b* is moved in the arrow J2 direction of part (c) of FIG. 11, the second maximum acceleration a2 of the feeding member 12*b* shown in part (c) of FIG. 11 is larger than the acceleration "μ0×g" of the feeding member 12*b* when the toner t slides on the feeding member 12*b*. For this reason, the toner t is moved in the feeding member 12*b* disposed on the horizontal surface in the arrow J1 direction relative to the feeding member 12*b*.

That is, even when a locus in which the feeding member 12*b* moves through one reciprocation is the same, the respective pieces of the acceleration are appropriately set so as to satisfy the relationship represented by the above-described symbolic formula 2. As a result, it is possible to increase an amount of the toner tin which the toner t is moved in the arrow J1 direction of part (b) of FIG. 11 which is the direction in which the toner t approaches, by the feeding member 12*b* through one reciprocation of the feeding member 12*b*.

<Acceleration Setting Condition of Feeding Member 12*b* in which Toner t Cannot be Fed>

Next, an acceleration setting condition of the feeding member 12*b* in which the toner t cannot be fed will be described. The case where a relationship between the second maximum acceleration a2 of the feeding member 12*b* shown in part (c) of FIG. 11 and the acceleration "μ0×g" of the feeding member 12*b* when the toner t slides on the feeding member 12*b* is set so as to satisfy the following symbolic formula 3 will be considered.

(Symbolic Formula 3)

a2>"0×g"

At this time, even when the feeding member 12*b* moves in the arrow J2 direction of part (c) of FIG. 11 at the second maximum acceleration a2, the toner t does not slide on the feeding member 12*b*. Accordingly, by the feeding member 12*b* moving in the arrow J2 direction of part (c) of FIG. 11, the toner t cannot be fed in the direction in which the toner t moves toward the developing roller 10*d* relative to the feeding member 12*b*.

That is, as shown in parts (a) to (c) of FIG. 11, in a state in which the cartridge B is mounted in the apparatus main assembly A1, the inner wall surface 14*d*1 of the bottom of the developer container 14 is disposed with respect to the horizontal direction. In that state, the feeding member 12*b* moves in the arrow J2 direction of part (c) of FIG. 11. At this time, the toner t slides on the feeding member 12 and moves in the arrow J1 direction of part (b) of FIG. 11 relative to the feeding member 12*b*. Thus, a relationship between the second maximum acceleration a2 and the acceleration "μ0×g" of the feeding member 12*b* when the toner t slides on the feeding member 12*b* is set so as to satisfy the following symbolic formula 4.

(Symbolic Formula 4)

"μ0×g"<a2

The case where as regards the coefficient of static friction μ0 between the surface of the feeding member 12*b* and the toner t, the toner t is placed on the feeding member 12*b* and the feeding member 12*b* is inclined with respect to the horizontal surface by a predetermined angle θ will be considered. At that time, the coefficient of static friction μ0 is calculated by the following symbolic formula 4 with use of the angle θ formed between the horizontal surface and the surface of the feeding member 12*b* when the toner t slides down the feeding member 12*b*.

(symbolic formula 5)

$\mu 0 = \tan \theta$

In the symbolic formula 5, when tan θ is larger than the coefficient of static friction μ0, the toner t on the feeding member 12*b* slides down the feeding member 12*b* due to a slide generating at an interface between the surface of the feeding member 12*b* and the toner t and a slide generating at an interface between the toner t and the toner t.

The toner t slides relative to the feeding member 12*b* vibrating in the arrow J1 direction of part (b) of FIG. 11 and in the arrow J2 direction of part (c) of FIG. 11 by the restoring force of the urging member 16. This is not limited to a slide, between the feeding member 12*b* and the toner t, generating at the interface between the surface of the feeding member 12*b* and the toner t. In addition, a slide generating at an interface between the toner t and the toner t which are positioned above the surface of the feeding member 12*b* is also included.

With rotation of the rotatable member 15 in the arrow X direction of part (a) of FIG. 10, the acting portion 15*a* of the rotatable member 15 contacts the portion-to-be-worked 12*a*3 of the swingable and rotatable member 12*a* and pushes and rotates the swingable and rotatable member 12*a* in the clockwise direction of part (b) of FIG. 10 against the urging force of the urging member 16. Then, the acting portion 15*a* of the rotatable member 15 is disconnected from the portion-to-be-worked 12*a*3 of the swingable and rotatable member 12*a* and rotates the swingable and rotatable member 12*a* in the counterclockwise direction of part (c) of FIG. 10 by the urging force of the urging member. Thereafter, the swingable and rotatable member 12*a* alternately repeats the rotation in the clockwise direction of part (b) of FIG. 10 and the rotation in the counterclockwise direction of part (c) of FIG. 10 by the restoring force of the urging member 16 and thus such motion attenuates.

At this time, reciprocating motion in which the movement of the feeding member 12*b* in the arrow J1 direction of part (b) of FIG. 11 and the movement of the feeding member 12*b* in the arrow J2 direction of part (c) of FIG. 11 are alternately repeated via the swing shaft 12*c* fixed to the swingable and rotatable member 12*a* is repeated. As a result, the toner t on the feeding member 12*b* is fed in the arrow J1 direction of part (b) of FIG. 11 which is the feeding direction in which the toner t is fed toward the developing roller 10*d* relative to the feeding member 12*b*.

In this embodiment, the relationship among the first maximum acceleration a1, the second maximum acceleration a2 and the acceleration "μ0×g" of the feeding member 12*b* when the toner t slides on the feeding member 12*b* was set so as to satisfy the above-described symbolic formula 2.

<Effect>

The feeding member 12*b* repeating the reciprocating motion by the developer feeding portion 21 feeds the toner tin the toner accommodating portion 14*t* in the arrow J1 direction of FIG. 3 which is the direction in which the toner t approaches the developing roller 10*d*, and is capable of stably supplying the toner t to the developing roller 10*d*. When the amount of the toner tin the toner accommodating portion 14*t* is large, as shown in FIG. 3, the feeding of the toner t is carried out toward the developing roller 10*d* by the feeding member 12*b*, so that the toner tin the toner accommodating portion 14*t* becomes a leveled state.

Then, the toner tin the toner accommodating portion 14*t* is stably supplied to the developing roller 10*d* by gravitation and a feeding force by the feeding member 12*b*. For this reason, in the case where the toner t carried on the surface of the developing roller 10*d* is consumed by the image forming process, the toner t is immediately supplied to the surface of the developing roller 10*d* by the feeding force of the feeding member 12*b*.

Further, as shown in FIG. 12, when the amount of the toner tin the toner accommodating portion 14*t* is small, the toner t positioned apart from the developing roller 10*d* in the toner accommodating portion 14*t* is collected toward the developing roller 10*d* by the reciprocating motion of the feeding member 12*b*. Then, the toner t is stably supplied toward the developing roller 10*d* by the feeding force of the feeding member 12*b*.

In the case where the toner t on the surface of the developing roller 10*d* is consumed by the image forming process, similarly as in a full state of the amount of the toner tin the toner accommodating portion 14*t*, the toner t is immediately fed to the surface of the developing roller 10*d* by the feeding force of the feeding member 12*b*. As a result, even in the case where the toner t on the surface of the developing roller 10*d* is consumed by the image forming process when the amount of the toner tin the toner accommodating portion 14*t* is small, the supply of the toner t to the surface of the developing roller 10*d* is immediately carried out by the feeding force of the feeding member 12*b*.

At the developer feeding portion 21 in this embodiment, even when the amount of the toner tin the toner accommodating portion 14*t* is small, the toner t can be stably supplied to the developing roller 10*d* by the feeding member 12*b*. As a result, the image forming apparatus A is capable of forming a stable image.

Further, in FIGS. 3 and 12, the toner t is fed in the direction in which the toner t approaches the developing roller 10*d*, by the reciprocating motion of the feeding member 12*b*. At that time, the case where powder pressure of the toner t applied to the developing roller 10*d* by the feeding member 12*b* exceeds a certain value will be considered. Then, the toner t also slides on the feeding member 12*b* when the feeding member 12*b* moves in the arrow J1 direction. For that reason, the powder pressure of the toner t applied to the developing roller 10*d* by the feeding member 12*b* is prevented from excessively increasing to not less than a frictional force between the feeding member 12*b* and the toner t or to not less than a frictional force between the toner t and the toner t.

Here, the number of rotations of the rotatable member 15 is 240 rpm (rotation per minute). The acting portion 15*a* of the rotatable member 15 rotating in the arrow X direction of part (b) of FIG. 10 contacts the portion-to-be-worked 12*a*3 of the swingable and rotatable member 12*a*. Then, the acting portion 15*a* pushes and rotates the swingable and rotatable member 12*a* in the clockwise direction of part (b) of FIG. 10 against the urging force of the urging member 16. A frequency of the force applied at that time is 8 Hz. Further, an angle at which the acting portion 15*a* of the rotatable member 15 contacts the portion-to-be-worked 12*a*3 of the swingable and rotatable member 12*a* and rotates the swingable and rotatable member 12*a* in the clockwise direction of part (b) of FIG. 10 against the urging force of the urging member 16 was 30 degrees.

Further, the first position 12*b*20 in the neutral state of the free end portion 12*b*2 of the feeding member 12*b* shown in part (a) of FIG. 11 will be considered. Further, the second position 12*b*21 of the free end portion 12*b*2 of the feeding member 12*b* shown in part (b) of FIG. 11 will be considered. A movement distance L1, of the free end portion 12*b*2 of the feeding member 12*b*, which is a difference between the first position 12*b*20 and the second position 12*b*21 is about 1.5 mm.

Further, the first position 12*b*20 in the neutral state of the free end portion 12*b*2 of the feeding member 12*b* shown in part (a) of FIG. 11 will be considered. Further, the third position 12*b*22 of the free end portion 12*b*2 of the feeding member 12*b* shown in part (b) of FIG. 11 will be considered. A movement distance L2, of the free end portion 12*b*2 of the feeding member 12*b*, which is a difference between the first position 12*b*20 and the third position 12*b*22 was set at a value smaller than the movement distance L1. This movement distance L2 changes relative to the restoring force of the urging member 16 by the action of a weight of the toner t left in the toner accommodating portion 14*t* on the feeding member 12*b*.

Further, the acting portion 15*a* of the rotatable member 15 rotating in the arrow X direction of part (b) of FIG. 10 contacts the portion-to-be-worked 12*a*3 of the swingable and rotatable member 12*a*. Then, the acting portion 15*a* pushes and rotates the swingable and rotatable member 12*a* in the clockwise direction of part (b) of FIG. 10 against the urging force of the urging member 16. Then, the swingable and rotatable member 12*a* rotates 30 degrees. At that time, the urging force applied from the urging member 16 to the engaging portion 12*a*2 of the swingable and rotatable member 12*a* is 300 gf (2.94 N). Further, the weight of the toner tin the toner accommodating portion 14*t* is 120 g.

Incidentally, the above-described conditions are not limited thereto, but can also be appropriately selected depending on a kind and a characteristic of the toner t and shapes, materials, arrangements and the like of the respective members. By the developer feeding portion 21, a degree of a fluctuation in supply of the toner t toward the developing roller 10*d* can be reduced and thus the supply of the toner t toward the developing roller 10*d* can be stabilized.

Second Embodiment

Next, structures of a developer accommodating unit, a cartridge and an image forming apparatus in Second Embodiment according to the present invention will be described with reference to FIGS. 13 and 14. Incidentally, constituent elements constituted similarly as in the above-described First Embodiment will be omitted from description by adding thereto the same reference numerals or symbols or by adding thereto the same member (part) names even when the reference numerals or symbols are different from those in the First Embodiment. FIG. 13 is a perspective view showing a structure of the developer feeding portion 21 in this embodiment. FIG. 14 is a side view showing the structure of the developer feeding portion 21 in this embodiment.

In the First Embodiment described above, as a constitution in which the acceleration is applied to the feeding member 12*b*, an example constituted by providing the developer container 14 with the rotatable member 15 including the projected acting portion 15*a*, and with the swingable and rotatable member 12*a*, the urging member 16 and the swing shaft 12*c* was described. In the constitution of the First Embodiment, when the acting portion 15*a* of the rotatable member 15 and the portion to be worked 12*a*3 of the swingable and rotatable member 12*a* contact each other, an abrupt load fluctuation occurs. In this embodiment, in order to reduce such abrupt load fluctuation, as shown in FIG. 13, a constitution in which a rotatable member 150 is provided with a cam portion 150*a* as the moving member for causing a swingable and rotatable member 120*a* as the swing transmission member to make swing motion is employed.

Next, using FIG. 13, structures of the rotatable member 150 including the cam portion 150*a* and the swingable and rotatable member 120*a* will be described. A cam surface 150*a*3 of the cam portion 150*a* provided on the rotatable member 150 rotating in the arrow X direction of FIG. 13 slides on a portion-to-be-worked 120*a*3 provided on the swingable and rotatable member 120*a*. The swingable and rotatable member 120*a* is constituted as the swing transmission member for moving the feeding member 12*b*. The cam portion 150*a* is provided with peak points 150*a*1 which are disposed at positions deviated in phase from each other by 180 degrees along the circumferential direction of the rotatable member 150 and which have a maximum diameter and is provided with valley points 150*a*2 subsequent to the associated peak points 150*a*1, respectively.

Incidentally, in FIGS. 13 and 14, the swingable and rotatable member 120*a* includes a cylindrical supported portion 120*a*1 and an engaging portion 120*a*2. The cylindrical portion 16*c* of the urging member 16 is engaged around and supported by the outer peripheral surface of the cylindrical supporting portion 120*a*1 provided in the swingable and rotatable member 120*a*, and the movable arm 16*b* of the urging member 16 is engaged with the engaging portion 120*a*2 provided on the swingable and rotatable member 120*a*.

The rotatable member 150 rotates in the arrow X direction of FIG. 14. As a result, the portion-to-be-worked 120*a*3 sliding on the cam surface 150*a*3 from the valley point 150*a*2 toward the peak point 150*a*1 is pushed and rotated by the cam surface 150*a*3 gradually increasing in diameter against the urging force of the urging member 16. As a result, the swingable and rotatable member 120*a* rotates in the clockwise direction of FIG. 14.

That is, the cam surface 150*a*3 of the cam portion 150*a* provided on the rotatable member 150 as the rotating movable member slides on the portion-to-be-worked 120*a*3 provided on and projected from the outer peripheral surface of the swingable and rotatable member 120*a* as the swing transmission member. Then, the cam surface 150*a*3 pushes and rotates the swingable and rotatable member 120*a* in the clockwise direction of FIG. 14 as the first direction against the urging force of the urging member 16. Then, by the rotation of the swingable and rotatable member 120*a* in the first direction, the feeding member 12*b* is moved in the direction in which the feeding member 12*b* approaches the developing roller 10*d* as the developer carrying member. The rotatable member 150 is further rotated in the arrow X direction of FIG. 14, and the portion-to-be-worked 120*a*3 passes through the peak point 150*a*1. Then, by the urging force of the urging member 16, the swingable and rotatable member 120*a* is rotated in the counterclockwise direction of FIG. 14.

That is, the peak point 150*a*1 of the cam portion 150*a* of the rotatable member 150 passes through the portion-to-be-worked 120*a*3 of the swingable and rotatable member 120*a*. Then, by the urging force of the urging member 16, the swingable and rotatable member 120*a* is rotated in the counterclockwise direction FIG. 14 as the second direction opposite to the first direction described above. As a result, the feeding member 12*b* is moved in the direction in which the feeding member 12*b* is moved away from the developing roller 10*d*. Thereafter, the portion-to-be-worked 120*a*3 repeats an operation in which the portion-to-be-worked 120*a*3 slides on the cam surface 150*a*3 from the valley point 150*a*2 toward the peak point 150*a*1.

In the above-described First Embodiment, each of the acting portion 15*a* of the rotatable member 15 and the portion-to-be-worked 12*a*3 of the swingable and rotatable member 12*a* was constituted by the projection projected in the associated radial direction. In this embodiment, compared with the constitution of First Embodiment, a degree of abrupt load fluctuation of a rotational torque applied to the rotatable member 150 can be reduced.

Here, a constitution in which a drive transmission means such as a gear train for transmitting the driving force from the motor 22 shown in FIG. 5 which is the driving means to the rotatable member 150 and a drive transmission means such as a gear train for transmitting the rotational driving force to the developing roller 10*d* are connected each other will be considered. In such a case, the influence of the abrupt load fluctuation of the rotational torque of the rotatable member 150 on the rotation of the developing roller 10*d* can be reduced through the drive transmission means such as the gear train. For this reason, it is possible to suppress image defects such as an occurrence of a periodical band-like shade (darkness) non-uniformity which is called banding. Other constituent elements are constituted similarly as those in the First Embodiment, and a similar effect can be obtained.

Third Embodiment

Next, structures of a developer accommodating unit, a cartridge and an image forming apparatus in Third Embodiment according to the present invention will be described with reference to FIGS. 15 and 16. Incidentally, constituent elements constituted similarly as in the above-described respective Embodiments will be omitted from description by adding thereto the same reference numerals or symbols or by adding thereto the same member (part) names even when the reference numerals or symbols are different from those in the respective Embodiments. FIG. 15 is a perspective view showing a structure of the developer feeding portion 21 in this embodiment. FIG. 16 is a side view showing the structure of the developer feeding portion 21 in this embodiment.

In this embodiment, similarly as in the above-described Second Embodiment, the degree of the abrupt load fluctuation when the acting portion 15*a* of the rotatable member 15 and the portion-to-be-worked 21*a*3 of the swingable and rotatable member 12*a* contact each other in the above-described First Embodiment is reduced. In this embodiment, as shown in FIGS. 15 and 16, a constitution using Geneva mechanism for converting continuous rotational motion of a rotatable member 151 as the moving member for causing a swingable and rotatable member 121*a* as the swing transmission member to make swing motion, into intermittent rotation of the swingable and rotatable member 121*a* is employed.

On a side surface 151*b* of the rotatable member 151, two pins 151*a* are provided and projected at two positions deviated in phase from each other by 180 degrees along the circumferential direction of the rotatable member 151. On the other hand, the swingable and rotatable member 121*a* includes a portion-to-be-worked 121*a*3 provided with a J-shaped slot 121*a*3*a*. The swingable and rotatable member 121*a* is constituted as the swing transmission member for moving the feeding member 12*b*. The rotatable member 151 rotates in the arrow X direction. Then, one pin 151*a* enters the slot 121*a*3*a* of the portion-to-be-worked 121*a*3 of the swingable and rotatable member 121*a*. Then, the swingable and rotatable member 121*a* rotates together with the rotatable member 151 in the clockwise direction of FIG. 16 against the urging force of the urging member 16.

That is, the pin 151*a* provided on and projected from the rotatable member 151 as the rotating movable member engages in the slot 121*a*3 provided on and projected from the outer peripheral surface of the swingable and rotatable member 121*a* as the swing transmission member. Then, the cam surface 150*a*3 pushes and rotates the swingable and rotatable member 121*a* in the clockwise direction of FIG. 14 as the first direction against the urging force of the urging member 16. Then, by the rotation of the swingable and rotatable member 121*a* in the first direction, the feeding member 12*b* is moved in the direction in which the feeding member 12*b* approaches the developing roller 10*d* as the developer carrying member.

When the rotatable member 151 is further rotated in the arrow X direction of FIG. 16, one pin 151*a* disengages from the slot 121*a*3 of the portion-to-be-worked 121*a*3, and by the urging force of the urging member 16, the swingable and rotatable member 121*a* is rotated in the counterclockwise direction of FIG. 16.

That is, the pin 151*a* of the rotatable member 151 disengages from the slot 121*a*3*a* of the swingable and rotatable member 121*a*. Then, by the urging force of the urging member 16, the swingable and rotatable member 121*a* is rotated in the counterclockwise direction FIG. 16 as the second direction opposite to the first direction described above. As a result, the feeding member 12*b* is moved in the direction in which the feeding member 12*b* is moved away from the developing roller 10*d*.

The rotatable member 151 further rotates in the arrow X direction of FIG. 16. Then, the other pin 151*a* deviated in phase from the above-described one pin 151*a* by 180 degrees enters the slot 121*a*3*a* of the portion-to-be-worked 121*a*3 of the swingable and rotatable member 121*a*. Then, the swingable and rotatable member 121*a* rotates together with the rotatable member 151 in the clockwise direction of FIG. 16 against the urging force of the urging member 16.

When the rotatable member 151 further rotates in the arrow X direction of FIG. 16, the other pin 151*a* disengages from the slot 121*a*3*a* of the portion-to-be-engaged 121*a*3 of the swingable and rotatable member 121*a*, and by the urging force of the urging member 16, the swingable and rotatable member 121*a* is rotated in the counterclockwise direction of FIG. 16. Thus, an operation in which the continuous rotational motion of the rotatable member 151 is converted into the intermittent rotation of the swingable and rotatable member 121*a* is repeated.

Incidentally, in FIGS. 15 and 16, the swingable and rotatable member 121*a* includes a cylindrical supporting portion 121*a*1 and an engaging portion 121*a*2. The cylindrical portion 16*c* of the urging member 16 is engaged with and supported by the outer peripheral surface of the cylindrical supporting portion 121*a* provided on the swingable and rotatable member 121*a*, and the movable arm 16*b* of the urging member 16 is engaged with the engaging portion 121*a*2 provided on the swingable and rotatable member 121*a*.

Also in this embodiment, similarly as in the above-described Second Embodiment, a degree of abrupt load fluctuation of a rotational torque applied to the rotatable member 151 can be reduced. For this reason, a constitution in which a drive transmission means such as a gear train for transmitting the driving force from the motor 22 shown in FIG. 5 which is the driving means to the rotatable member 151 and a drive transmission means such as a gear train for transmitting the rotational driving force to the developing roller 10*d* are connected each other will be considered. In such a case, the influence of the abrupt load fluctuation of the rotational torque of the rotatable member 151 on the rotation of the developing roller 10*d* can be reduced through the drive transmission means such as the gear train. For this reason, it is possible to suppress image defects such as the banding. Other constituent elements are constituted similarly as those in the above-described respective Embodiments, and a similar effect can be obtained.

Fourth Embodiment

Next, structures of a developer accommodating unit, a cartridge and an image forming apparatus in Fourth Embodiment according to the present invention will be described with reference to FIGS. 17 and 18. Incidentally, constituent elements constituted similarly as in the above-described respective Embodiments will be omitted from description by adding thereto the same reference numerals or symbols or by adding thereto the same member (part) names even when the reference numerals or symbols are different from those in the respective Embodiments. FIG. 17 is a perspective view showing a structure of the developer feeding portion 21 in this embodiment. FIG. 18 is a side view showing the structure of the developer feeding portion 21 in this embodiment.

In the above-described First to Third Embodiments, as the constitution in which the acceleration is applied to the feeding member 12*b*, an example of the case where the torsion coil spring is used as the urging member 16 was described. In this embodiment, as shown in FIG. 17, an example in which a leaf spring is used as an urging member 160 for urging a swingable and rotatable member 122*a* as the swing transmission member will be described.

As shown in FIG. 17, the urging member 160 is constituted by the leaf spring, and one end portion 160*a* of the urging member 160 comprising the leaf spring is fixed to the fixing portion 14*a*13 provided on the outer wall 14*a*1 of the developer container 14. Further, the other end portion 160*b* of the urging member 160 is engaged with an engaging portion 122*a*2 provided on the swingable and rotatable member 122*a*. The swingable and rotatable member 122*a* is constituted as the swing transmission member for moving the feeding member 12*b*.

The swingable and rotatable member 122*a* is rotatably supported by the outer wall 14*a*1 of the developer container 14. A part of the swingable and rotatable member 122*a* engages with the swing shaft 12*c* provided in the toner accommodating portion 14*t* through the communicating opening 14*a*12 provided in the outer wall 14*a*1. As a result, the urging force of the urging member 160 constituted by the leaf spring is set so as to act on the swingable and rotatable member 121*a* and the swing shaft 12*c* with respect to the rotational direction.

In FIGS. 17 and 18, the swingable and rotatable member 122*a* is provided with a portion-to-be-worked 122*a*3. When the rotatable member 15 rotates in the arrow X direction of FIG. 18, the acting portion 15*a* of the rotatable member 15 contacts the portion-to-be-worked 122*a*3 of the swingable and rotatable member 122*a*, and pushes and rotates the swingable and rotatable member 122*a* in the clockwise direction of FIG. 18 against the urging force of the urging member 160.

Thereafter, the acting portion 15*a* of the rotatable member 15 disconnects from the portion-to-be-worked 122*a*3 of the swingable and rotatable member 122*a*, and the swingable and rotatable member 122*a* rotates in the counterclockwise direction of FIG. 18 by the urging force of the urging member 160. Thereafter, the rotational force of the swingable and rotatable member 122*a* is attenuated while the swingable and rotatable member 122*a* alternately rotates in the counterclockwise direction of FIG. 18 and the counterclockwise direction of FIG. 18 by the restoring force of the urging member 160, and thereafter, the swingable and rotatable member 122*a* returns to a neutral position shown in FIG. 18.

The rotatable member 15 further rotates in the arrow X direction of FIG. 18. Then, the other acting portion 15*a* deviated in phase from the above-described acting portion 15*a* by 180 degrees along the circumferential direction of the rotatable member 15 contacts the portion-to-be-worked 122*a*3 of the swingable and rotatable member 122*a*. Further, the other acting portion 15*a* pushes and rotates the swingable and rotatable member 122*a* in the clockwise direction of FIG. 18 against the urging force of the urging member 160.

Thereafter, the other acting portion 15*a* of the rotatable member 15 disconnects from the portion-to-be-worked 122*a*3 of the swingable and rotatable member 122*a*, and the swingable and rotatable member 122*a* rotates in the counterclockwise direction of FIG. 18 by the urging force of the urging member 160. Thereafter, the rotational force of the swingable and rotatable member 122*a* is attenuated while the swingable and rotatable member 122*a* alternately rotates in the counterclockwise direction of FIG. 18 and the counterclockwise direction of FIG. 18 by the restoring force of the urging member 160, and thereafter, the swingable and rotatable member 122*a* returns to a neutral position shown in FIG. 18. This operation is repeated.

A mounting position of the urging member 160 as the urging means is set at a position, which is the neutral position of the swingable and rotatable member 122*a*, where the urging force applied from the urging member 160 to the swingable and rotatable member 122*a* with respect to the rotation direction of the swingable and rotatable member 122*a* is zero. At this time, the free end portion 12*b*2 of the feeding member 12*b* is set at the first position 12*b*20 shown in part (a) of FIG. 11.

In the above-described First to Third Embodiments, the neutral positions of the swingable and rotatable members 12*a*, 120*a* and 121*a* are defined by the angle formed by the fixing arm 16*a* and the movable arm 16*b* of the urging member 16 comprising the torsion coil spring. Due to a processing error of the urging member 16, the angle formed by the fixing arm 16*a* and the movable arm 16*b* deviates in an amount corresponding to the processing error. For this reason, the neutral positions of the swingable and rotatable members 12*a*, 120*a* and 121*a* deviate.

As a result, the position of the free end portion 12*b*2 of the feeding member 12 deviates from the first position 12*b*20 shown in part (a) of FIG. 11. In this embodiment, the urging member 160 is constituted by the leaf spring. The leaf spring is smaller in processing error than the torsion coil spring, and therefore, the neutral position of the swingable and rotatable member 122*a* is easily controlled. Other constituent elements are constituted similarly as those in the above-described respective Embodiments, and a similar effect can be obtained.

Fifth Embodiment

Next, structures of a developer accommodating unit, a cartridge and an image forming apparatus in Fifth Embodiment according to the present invention will be described with reference to FIG. 19. Incidentally, constituent elements constituted similarly as in the above-described respective Embodiments will be omitted from description by adding thereto the same reference numerals or symbols or by adding thereto the same member (part) names even when the reference numerals or symbols are different from those in the respective Embodiments. FIG. 19 is a perspective view showing a structure of the developer feeding portion 21 in this embodiment.

In this embodiment, as shown in FIG. 19, the feeding member 12*b* comprising the sheet member is provided with a plurality of communicating openings 12*b*5 consisting of through holes along an axial direction of the swing shaft 12*c*. The toner t as the developer is capable of passing through the feeding member 12*b* via the communicating openings 12*b*5. As regards the feeding member 12*b* shown in FIG. 19, the toner tin the toner accommodating portion 14*t* is capable of moving through the feeding member 12*b* via the communicating openings 12*b*5 provided in the feeding member 12*b*.

The toner tin the toner accommodating portion 14*t* is capable of moving from a right side (sheet lower surface side) of the feeding member 12*b* in FIG. 3 to a left side (sheet upper surface side) of the feeding member 12*b* in FIG. 3 where feeding power is higher. For this reason, the toner tin the toner accommodating portion 14*t* can be further efficiently fed toward the developing roller 10*d* by the feeding member 12*b*. Other constituent elements are constituted similarly as those in the above-described respective Embodiments, and a similar effect can be obtained.

Sixth Embodiment

Next, structures of a developer accommodating unit, a cartridge and an image forming apparatus in Sixth Embodiment according to the present invention will be described with reference to FIGS. 20 and 21. Incidentally, constituent elements constituted similarly as in the above-described respective Embodiments will be omitted from description by adding thereto the same reference numerals or symbols or by adding thereto the same member (part) names even when the reference numerals or symbols are different from those in the respective Embodiments. FIG. 20 is a perspective view showing a structure of the developer feeding portion 21 in this embodiment. FIG. 21 is a sectional view showing the structure of the developer feeding portion 21 in this embodiment.

In the above described respective embodiments, an example in which the fixing portion 12*b*1 of the sheet shaped feeding member 12*b* is fixed to the swing shaft 12*c* was described. In this embodiment, a constitution in which a feeding member 26 which is prepared by integrally molding a swing shaft 26*c*, a flexible portion 26*a* (sheet member) and a plate portion 26*b* (sheet member) as shown in FIG. 20 and which is made of a resin material is used was employed. The feeding member 26 is disposed on a lower side of the toner t as the developer and alternately moves in directions of arrows J1 and J2 of FIG. 21, so that the toner ton the feeding member 26 is fed in a direction in which the toner t moves toward the developing roller 10*d*.

As a material of the feeding member 26, polyacetal (polyoxymethylene (POM)) is used, but is not limited thereto. As other materials of the feeding member 26, it is possible to use polyethylene terephthalate (PET), polyethylene (PE) and polypropylene (PP).

As other materials of the feeding member 26, it is possible to appropriately use acrylonitrile butadiene styrene copolymer (ABS), polycarbonate (PC), polystyrene (PS) and the like.

In the toner accommodating portion 14*t* of the developer container 14, the toner t as the developer is accommodated. In the toner accommodating portion 14*t*, the feeding member 26 is rotatably supported. On the other hand, on the outer wall 14*a*1 of the developer container 14, the swingable and rotatable member 12*a* is rotatably supported. A part of the swingable and rotatable member 12*a* is engaged with one end portion of the swing shaft 26*c* of the feeding member 26 provided in the toner accommodating portion 14*t* through the communicating opening 14*a*12 comprising a through hole provided in the outer wall 14*a*1 of the developer container 14, so that the swingable and rotatable member 12*a* and the feeding member 26 rotate integrally with each other.

The feeding member 26 in this embodiment is constituted by including the flexible portion 26*a* of 0.3 mm in thickness, the plate portion 26*b* of 1 mm in thickness, and the swing shaft of 5 mm in outer diameter. Incidentally, the above-described conditions are not limited thereto, but can also be appropriately set depending on a kind and a characteristic of the toner t and shapes, materials, arrangements and the like of the respective members.

As shown in FIG. 21, the flexible portion 26*a* of the feeding member 26 is deformed. As a result, a lower surface of the plate portion 26*b* and a free end portion 26*b*1 are disposed so as to extend along the inner wall surface 14*d*1 of the bottom of the cap portion 14*d* of the developer container 14 on the toner accommodating portion 14*t* side. The feeding member 26 is constituted so as to operate in interrelation with motion of the swingable and rotatable member 12*a* as the swing transmission member on the inner wall surface 14*d*1 of the bottom of the developer container 14. The plate portion 26*b* is disposed on a lower side of the toner t accommodated in the toner accommodating portion 14*t*. As shown in FIG. 21, the feeding member 26 is provided so as to be alternately movable in the arrow J1 direction and the arrow J2 direction of FIG. 21. Other constituent elements are constituted similarly as those in the above-described respective Embodiments, and a similar effect can be obtained.

Seventh Embodiment

Next, structures of a developer accommodating unit, a cartridge and an image forming apparatus in Seventh Embodiment according to the present invention will be described with reference to FIGS. 22 and 23. Incidentally, constituent elements constituted similarly as in the above-described respective Embodiments will be omitted from description by adding thereto the same reference numerals or symbols or by adding thereto the same member (part) names even when the reference numerals or symbols are different from those in the respective Embodiments. FIG. 22 is a perspective view showing a structure of the developer feeding portion 21 in this embodiment. FIG. 23 is a sectional view showing the structure of the developer feeding portion 21 in this embodiment.

In the Sixth Embodiment, an example in which the flexible portion 26*a* of the feeding member 26 is deformed and the plate portion 26*b* alternately reciprocate in the arrow J1 and J2 directions of FIG. 21 along the inner wall surface 14*d*1 of the bottom of the developer container 14 was described. In this embodiment, as shown in FIG. 22, a constitution in which a feeding member 27 which is prepared by integrally molding a swing shaft 27*c* being swingable, an arm portion 27*a*, and a plate-shaped arcuate portion 27*b* and which is made of a resin material is used is employed.

The arcuate portion 27*b* of the feeding member 27 has a shape along the curved inner wall surface 14*d*1 of the bottom of the cap portion 14*d* of the developer container 14. The arcuate portion 27*b* is supported via the arm portion 27*a* by the swing shaft 27*c* disposed in parallel to the axial direction of the developing roller 10*d* as the developer carrying member in the toner accommodating portion 14*t* of the developer container 14.

The swingable and rotatable member 12*a* is rotatably supported by the outer wall 14*a*1 of the developer container 14. The feeding member 27 is rotatably supported in the toner accommodating portion 14*t* of the developer container 14. One end portion of the swing shaft 27*c* of the feeding member 27 with respect to the axial direction of the swing shaft 27*c* is engaged with the swingable and rotatable member 12*a* as the swing transmission member, so that the swing shaft 27*c* and the swingable and rotatable member 12*a* rotate integrally with each other.

The arcuate portion 27*b* of the feeding member 27 is disposed on a lower side of the toner t as the developer in the toner accommodating portion 14*t* of the developer container 14. Then, the arcuate portion 27*b* alternately moves in the clockwise direction and the counterclockwise direction on an arc about the swing shaft 27*c* shown in FIG. 23. As a result, the arcuate portion 27*b* alternately moves along the arrow J1 and J2 directions of FIG. 23. As a result, the toner t on the arcuate portion 27*b* of the feeding member 27 is fed in the direction in which the toner t approaches the developing roller 10*d*.

One end portion of the swing shaft 27*c* of the feeding member 27 provided in the toner accommodating portion 14*t* is engaged with a part of the swingable and rotatable member 12*a* through the communicating opening 14*a*12 comprising the through hole provided in the outer wall 14*a*1. As a result, the feeding member 27 rotates integrally with the swingable and rotatable member 12*a*. The arcuate portion 27*b* and the swing shaft 27*c* are connected by the arm portion 27*a*. The arcuate portion 27*b* rotates about the rotation center of the swing shaft 27*c* of the feeding member 27.

The inner wall surface 14*d*1 of the bottom of the cap portion 14*d* on the toner accommodating portion 14*t* side so that the arcuate portion 27*b* of the feeding member 27 extends along the inner wall surface 14*d*1. The feeding member 27 is constituted by including the arm portion of 1.5 mm in thickness, the arcuate portion 27*b* of 1 mm in thickness, and the swing shaft 27*c* of 5 mm in outer diameter. Incidentally, the above-described respective conditions are not limited thereto, but can also be appropriately set depending on a kind and a characteristic of the toner t and shapes, materials, arrangements and the like of the respective members. The feeding member 27 performs a reciprocating rotational operation about the swing shaft 27*c* in interrelation with motion of the swingable and rotatable member 12*a* as the swing transmission member on the inner wall surface 14*d*1 of the bottom of the developer container 14. The arcuate portion 27*b* is disposed on a lower side of the toner t accommodated in the toner accommodating portion 14*t*. The rotatable member 15 rotates in the arrow X direction of FIG. 22, the acting portion 15*a* of the rotatable member 15 contacts the portion-to-be-worked 12*a*3 of the swingable and rotatable member 12*a*, and pushes and rotates the swingable and rotatable member 12*a* in the clockwise direction of FIG. 23 against the urging force of the urging member 16. Thereafter, when the acting portion 15*a* of the rotatable member 15 disconnects from the portion-to-be-worked 12*a*3 of the swingable and rotatable member 12*a*, the swingable and rotatable member 12*a* is pushed and rotated in the counterclockwise direction of FIG. 23 by the urging force of the urging member 16.

The swingable and rotatable member 12*a* alternately repeats rotation in the clockwise direction of FIG. 23 and rotation in the counterclockwise direction of FIG. 23 until the swingable and rotatable member 12*a* returns to the neutral position through attenuation of the restoring force of the urging member 16. At this time, the arcuate portion 27*b* of the feeding member 27 also alternately repeats rotation in the clockwise direction of FIG. 23 and rotation in the counterclockwise direction of FIG. 23 about the swing shaft 27*c*.

Thereafter, the rotatable member 15 further rotates in the arrow X direction of FIG. 18. Then, the other acting portion 15*a* provided at a position deviated in phase from the above-described acting portion 15*a* by 180 degrees along the circumferential direction of the rotatable member 15 contacts the portion-to-be-worked 12*a*3 of the swingable and rotatable member 12*a*. Further, the rotatable member 15 pushes and rotates the swingable and rotatable member 12*a* in the clockwise direction of FIG. 23 against the urging force of the urging member 16. Thereafter, the other acting portion 15*a* of the rotatable member 15 disconnects from the portion-to-be-worked 12*a*3 of the swingable and rotatable member 12*a*. Then, the swingable and rotatable member 12*a* is pushed and rotated in the counterclockwise direction of FIG. 23 by the urging force of the urging member 16.

The swingable and rotatable member 12*a* alternately repeats rotation in the clockwise direction of FIG. 23 and rotation in the counterclockwise direction of FIG. 23 until the swingable and rotatable member 12*a* returns to the neutral position through attenuation of the restoring force of the urging member 16. With this operation, the arcuate portion 27*b* of the feeding member 27 also alternately repeats rotation in the clockwise direction of FIG. 23 and rotation in the counterclockwise direction of FIG. 23 about the swing shaft 27*c*. As a result, the feeding member 27 reciprocates and moves in the rotational direction about the swing shaft 27*c* along the arrow J1 and J2 directions of FIG. 23 in the toner accommodating portion 14*t* of the developer container 14.

In this embodiment, as a material of the feeding member 27, polyacetal (polyoxymethylene (POM)) is used, but is not limited thereto. As other materials of the feeding member 26, it is possible to use polyethylene terephthalate (PET), polyethylene (PE) and polypropylene (PP).

As other materials of the feeding member 27, it is possible to appropriately apply acrylonitrile butadiene styrene copolymer (ABS), polycarbonate (PC), polystyrene (PS) and the like. Other constituent elements are constituted similarly as those in the above-described respective Embodiments, and a similar effect can be obtained.

Eighth Embodiment

Next, structures of a developer accommodating unit, a cartridge and an image forming apparatus in Eighth Embodiment according to the present invention will be described with reference to FIGS. 24 and 25. Incidentally, constituent elements constituted similarly as in the above-described respective Embodiments will be omitted from description by adding thereto the same reference numerals or symbols or by adding thereto the same member (part) names even when the reference numerals or symbols are different from those in the respective Embodiments. Part (a) of FIG. 24 is a sectional view showing a structure of a developing roller 42 in this embodiment, part (b) of FIG. 24 is a plan view showing a structure of an outer peripheral surface of the developing roller 42 in this embodiment, and part (c) of FIG. 24 is a sectional view of the outer peripheral surface of the developing roller 42 taken along C-C line of part (b) of FIG. 24. FIG. 25 is a sectional view showing a structure of a developing unit 101 in this embodiment.

As shown in part (c) of FIG. 24, the surface of the developing roller 42 as the developer carrying member for carrying the toner t as the developer is constituted by including an electroconductive (member) portion 32 and a plurality of dielectric (member) portions 31 which are higher in dielectric constant than the electroconductive portion 32 and which are capable of holding electric charges. An area occupied by the electroconductive portion 32 in the surface of the developing roller 42 is larger than an area occupied by the dielectric portions 31. The dielectric portions 31 are disposed so as to be scattered in the electroconductive portion 32. Each of the electroconductive portion 32 and the dielectric portions 31 is exposed to the surface of the developing roller 42 where the toner t is to be carried. Incidentally, in the following, the developing roller 42 is referred to as an MF developing roller 42 in some cases.

The developing roller 42 shown in part (a) of FIG. 24 is constituted by including a shaft core 42*a*, an elastic layer 42*b* made of an electroconductive rubber material provided on an outer peripheral surface of the shaft core 42*a*, and a surface layer 42*c* provided on an outer peripheral surface of the elastic layer 42*b*. On the elastic layer 42*b*, the surface layer 42*c* made of an electroconductive resin material in which dielectric particles different in work function (triboelectric series) from the toner t is formed. The surface layer 42*c* can be formed by, for example, coating or the like and can be prepared by polishing the surface of the coating.

The dielectric portions 31 provided in the surface layer 42*c* of the developing roller 42 shown in parts (b) and (c) of FIG. 24 are electrically charged. As a result, as indicated by electric force lines E in part (c) of FIG. 24, a minute closed electric field (micro field) is formed on the surface of the developing roller 42. Thus, the dielectric portions 31 and the electroconductive portion 32 are provided at the surface of the developing roller 42, and the surface of the developing roller 42 is rubbed, via the toner t as the developer, with a developing blade 10*e* as a regulating member provided opposed to the surface of the developing roller 42 as the developer carrying member.

As a result, the dielectric portions 31 are electrically charged, so that the minute closed electric field indicated by the electric force line E is formed on an adjacent portion to the electroconductive portion 32 which is adjacent to the associated dielectric portion 31. By gradient force (electrostatic attraction force directed toward a strong electric field portion) generated by the minute closed electric field, the toner t as the developer fed by the feeding member 12*b* is attracted to and carried on the surface of the developing roller 42.

In this embodiment, supply of the toner t toward the developing roller 42 can be further stably carried out by using the developing roller 42 described above. As a result, even in the case where an amount of the toner tin the toner accommodating portion 14*t* is small, the toner tin the toner accommodating portion 14*t* can be stably supplied to the developing roller 42 by the feeding member 12*b*. As a result, it is possible to provide a user with a further stabilized image quality by the image forming apparatus A.

Particularly, the feeding member (rotatable member) as in the conventional constitution is constituted by a rotation shaft and a stirring sheet which is mounted on the rotation shaft and which is rotated with rotation of the rotation shaft. In such a conventional feeding constitution, a flow of the toner t in a container is increased by a rotational operation of the stirring sheet, so that a carrying function of the toner tin the MF developing roller 42 including the dielectric portions 31 and the electroconductive portion 32 in the surface layer 42*c* shown in parts (b) and 8*c*) of FIG. 24 is lowered in some cases.

Specifically, the toner t is attracted by the gradient force generated by the minute closed electric field formed on the surface of the MF developing roller 42. For this reason, when the feeding member as in the conventional constitution is disposed in the neighborhood of the MF developing roller 42, the flow of the toner tin the neighborhood of the MF developing roller 42 is largely disturbed in some cases. As a result, it would be considered that attraction efficiency of the toner t on the surface layer 42*c* of the MF developing roller 42 lowers and thus the carrying function of the toner t lowers.

On the other hand, as shown in FIG. 25, in the developer feeding portion 21 in the present invention, feeding of the toner t is realized by moving the toner t along the inner wall surface 14*d*1 of the bottom on the toner accommodating portion 14*t* side with use of the sheet-shaped feeding member 12*b* mounted on the swing shaft 12*c*. For this reason, even when the feeding member 12*b* is provided in the neighborhood of the MF developing roller 42, the toner t can be supplied to the surface layer 42*c* of the MF developing roller 42 in a stable state without largely changing a flow of the toner tin the neighborhood of the MF developing roller 42. Here, a point of intersection of the free end portion 12*b*2 of the feeding member 12*b* and the surface layer 42*c* of the MF developing roller 42 when the free end portion 12*b*2 is extended in a toner feeding direction is defined as a contact point P.

Particularly, in this embodiment, the free end portion 12*b*2 of the feeding member 12*b* carries out reciprocating motion substantially in a normal direction H to the MF developing roller 42 at the contact point P. For this reason, the flow of the toner tin a direction (for example, a tangential direction S of a peripheral surface of the MF developing roller 42 at the contact point P) in which the toner t attracted to the surface layer 42*c* is scraped off is small, so that the toner t can be supplied to and carried by the MF developing roller 42 in a stable state.

Thus, the free end portion 12*b*2 of the feeding member 12*b* may preferably be constituted so as to make the reciprocating motion in a direction other than the tangential direction S of the peripheral surface of the MF developing roller 42. Particularly, when the MF developing roller 42 is seen from a rotation center 42*a*1 of the shaft core 42*a* thereof, a movement locus of the free end portion 12*b*2 of the feeding member 12*b* may preferably be disposed within a range T from −45 degrees with respect to the clockwise direction, from the normal direction H as a reference line, to +45 degrees with respect to the counterclockwise direction from the normal direction. Other constituent elements are constituted similarly as those in the above-described respective Embodiments, and a similar effect can be obtained.

OTHER EMBODIMENTS

In the above-described First to Sixth Embodiments, in a state in which the cartridge B is mounted in the apparatus main assembly A1 at the image forming position, the inner wall surface 14*d*1 of the bottom provided on the cap portion 14*d* of the developer container 14 on the toner accommodating portion 14*t* side is disposed substantially horizontally. Further, the feeding members 12*b* and 26 are disposed substantially horizontally along the inner wall surface 14*d*1 of the bottom of the developer container 14. Such examples were described. As another embodiment, the present invention is also applicable to the case where in the state in which the cartridge B is mounted in the apparatus main assembly A1 at the image forming position, the inner wall surface 14*d*1 of the bottom provided on the cap portion 14*d* of the developer container 14 on the toner accommodating portion 14*t* side is inclined with respect to the horizontal surface.

For example, in FIG. 3, the state in which the cartridge B is mounted in the apparatus main assembly A1 at the image forming position will be considered. In that state, a constitution in which the inner wall surface 14*d*1 of the bottom provided on the cap portion 14*d* of the developer container 14 on the toner accommodating portion 14*t* side has an upward inclination angle of 10 degrees from the horizontal surface with respect to the arrow J1 direction of FIG. 3 will be considered. Even in such a case, the feeding member 12*b* carries out the reciprocating motion in the arrow J1 and J2 directions of FIG. 3 along the inner wall surface 14*d*1 of the bottom having the upward inclination angle of 10 degrees from the horizontal surface with respect to the arrow J1 direction of FIG. 3. As a result, the toner t on the feeding member 12*b* accommodated in the toner accommodating portion 14*t* was capable of being fed in the arrow J1 direction of FIG. 3 which is the direction in which the toner t approaches the developing roller 10*d*.

Further, in FIG. 3, the state in which the cartridge B is mounted in the apparatus main assembly A1 at the image forming position will be considered. In that state, a constitution in which the inner wall surface 14*d*1 of the bottom provided on the cap portion 14*d* of the developer container 14 on the toner accommodating portion 14*t* side has a downward inclination angle of 10 degrees from the horizontal surface with respect to the arrow J1 direction of FIG. 3 will be considered. In that state, the case where the feeding member 12*b* carries out the reciprocating motion in the arrow J1 and J2 directions of FIG. 3 along the inner wall surface 14*d*1 of the bottom of the developer container 14 will be considered.

In this case, there is no limitation on inclination angle of the inner wall surface 14*d*1 of the bottom which is downwardly inclined from the horizontal surface with respect to the arrow J1 direction of FIG. 3. For this reason, even at an angle which is not more than an angle of repose of the toner t, the toner t on the feeding member 12*b* accommodated in the toner accommodating portion 14*t* was capable of being fed in the arrow J1 direction of FIG. 3 which is the direction in which the toner t approaches the developing roller 10*d*.

That is, the case where in the state in which the cartridge B is mounted in the apparatus main assembly A1 at the image forming position, the inclination angle, from the horizontal surface, of the inner wall surface 14*d*1 of the bottom provided on the cap portion 14*d* of the developer container 14 on the toner accommodating portion 14*t* side will be considered. This inclination angle may only be required to be an upward inclination angle of 10 degrees or less with respect to the arrow J1 direction of FIG. 3 and is applicable in an inclination angle range of 90 degrees or less in a downward direction with respect to the arrow J1 direction of FIG. 3.

Further, in the above-described respective embodiments, an example of the case where the respective urging members 16 and 160 are disposed outside the developer container 14 was described. As another example, a constitution in which the urging members are disposed in the toner accommodating portion 14*t* of the developer container 14 and apply the urging force to the respective swingable and rotatable members 12*a*, 120*a*, 121*a* and 122*a* and the respective swing shafts 12*c*, 26*c* and 27*c* with respect to the rotational directions may also be employed.

Further, in the above-described respective embodiments, an example of the case where the developing frame 14*a* and the cap portion 14*d* of the developer container 14 are constituted as separate members was described. As another example, the developer container 14 may also be prepared by integrally including the developing frame and the cap portion. Further, in the above-described respective embodiments, an example in which as the deceleration means of the respective feeding members 12*b*, 26 and 27, the restoring forces of the respective urging members 16 and 160 are utilized was described. As another example, as the deceleration means of the respective feeding members 12*b*, 26 and 27, known shock absorbing members or frictional sliding members may also be provided to the developer container 14.

Further, in the above-described embodiments, a constitution in which the cartridge B is used for forming a single color (monochromatic) image was employed. However, a plurality of cartridges B are provided for the respective colors of yellow, magenta, cyan and black, so that an image of a plurality of colors (for example, two-color image three-color image or full-color image or the like) may also be formed.

Further, in the above-described respective embodiments, an example of the developer feeding portion 21 for feeding the toner t to the developing rollers 10*d* and 42 was described. As another example, the present invention is also applicable to a developer feeding portion for feeding waste (residual) toner in a cleaner unit in which transfer residual toner remaining on the surface of the photosensitive drum 7 after the transfer which is scraped off by the cleaning blade is collected. Further, the present invention is also applicable to a developer feeding portion for feeding the toner t not only to the cartridge B but also to the developing device or a toner cartridge.

Further, the frequency at which the respective feeding members 12*b*, 26 and 27 make the reciprocating motion alternately in the arrow J1 and K2 directions may preferably be in a range of 1 Hz to 100 Hz. Further, the inclination angle, from the horizontal surface, of the feeding members 12*b*, 26 and 27 along the inner wall surface 14*d*1 of the bottom provided on the cap portion 14*d* of the developer container 14 on the toner accommodating portion 14*t* side will be considered. As regards this inclination angle, the toner t can be fed even when an upward inclination angle of the feeding members with respect to the arrow J1 direction of FIG. 3 is less than 10 degrees from the horizontal surface. Further, the toner t can be fed even when a downward inclination angle of the feeding members with respect to the arrow J1 direction of FIG. 3 is 60 degrees or less from the horizontal surface.

Further, the respective feeding members 12*b*, 26 and 27 in the above-described respective embodiments can also be constituted by an elastic member which is capable of feeding the toner t and which maintains a substantially plate-like shape. Thus, a degree of a supply fluctuation of the toner tin feeding of the toner t toward the developing rollers 10*d* and 42 by the feeding members 12*b*, 26 and 27 can be reduced. As a result, stable supply of the toner t to the developing rollers 10*d* and 42 can be carried out.

According to the present invention, supply of the developer to the developer carrying member can be stabilized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications to Nos. 2018-128933 filed on Jul. 6, 2018 and 2019-072587 filed on Apr. 5, 2019, which are hereby incorporated by reference herein in their entirety.

What is claimed is:

1. A developer accommodating unit comprising:

a developer container provided with an opening at a lower portion thereof with respect to a direction of gravitation in an attitude during use and configured to accommodate developer;

a developer carrying member mounted at the opening and configured to carry the developer; and a feeding member provided in the developer container and configured to feed the developer in the developer container toward the developer carrying member, wherein the feeding member is swingable about a predetermined supporting point as a swing center and is configured so that maximum acceleration when the feeding member moves toward the developer carrying member is less than maximum acceleration when the feeding member moves away from the developer carrying member.

2. A developer accommodating unit according to claim 1, wherein the feeding member includes:

a swing shaft which is swingable, and a sheet member mounted on the swing shaft.

3. A developer accommodating unit according to claim 2, wherein the sheet member has flexibility, and wherein at least a part of the sheet member is disposed so as to be adjacent to an inner wall surface of a bottom of the developer container.

4. A developer accommodating unit according to claim 2, wherein the sheet member is provided with a communication opening through which the developer is passable.

5. A developer accommodating unit according to claim 2, wherein the feeding member includes a flexible portion.

6. A developer accommodating unit according to claim 2, wherein a swing center of the swing shaft is positioned above a rotation center of the developer carrying member.

7. A developer accommodating unit according to claim 2, further comprising:

a swing transmission member configured to transmit a swing force for swinging the swing shaft, a moving member configured to move the swing transmission member in a first direction, and an urging member configured to urge the swing transmission member toward a second direction opposite to the first direction.

8. A developer accommodating unit according to claim 7, wherein the feeding member moves in a direction in which the feeding member moves toward the developer carrying member with movement of the swing transmission member in the first direction, and wherein the feeding member moves in a direction in which the feeding member moves away from the developer carrying member with movement of the swing transmission member in the second direction.

9. A developer accommodating unit according to claim 7, wherein the swing transmission member and the moving member are provided outside of the developer container.

10. A developer accommodating unit according to claim 7, wherein the swing transmission member is a swingable and rotatable member, and the moving member is a rotatable member.

11. A developer accommodating unit according to claim 10, wherein an acting portion provided on and projected from an outer peripheral surface of the rotatable member contacts a portion to be acted provided on and projected from an outer peripheral surface of the swingable and rotatable member and pushes and rotates the swingable and rotatable member in the first direction against an urging force of the urging member, and the feeding member is moved, by rotation of the swingable and rotatable member in the first direction, in a direction in which the feeding member is moved toward the developer carrying member, and wherein when the acting portion is detached from the portion to be acted, by rotation of the swingable and rotatable member in the second direction opposite to the first direction by the urging force of the urging member, the feeding member is moved in a direction in which the feeding member is moved away from the developer carrying member.

12. A developer accommodating unit according to claim 10, wherein a cam portion provided on an outer peripheral surface of the rotatable member slides on a portion to be acted provided on and projected from an outer peripheral surface of the swingable and rotatable member and pushes and rotates the swingable and rotatable member in the first direction against an urging force of the urging member, and the feeding member is moved, by rotation of the swingable and rotatable member in the first direction, in a direction in which the feeding member is moved toward the developer carrying member, and wherein when a peak point of the cam portion passes through the portion to be acted, by rotation of the swingable and rotatable member in the second direction opposite to the first direction by the urging force of the urging member, the feeding member is moved in a direction in which the feeding member is moved away from the developer carrying member.

13. A developer accommodating unit according to claim 10, wherein a pin provided on and projected from a side surface of the rotatable member engages in a slot provided on and projected from an outer peripheral surface of the swingable and rotatable member and pushes and rotates the swingable and rotatable member in the first direction against an urging force of the urging member, and the feeding member is moved, by rotation of the swingable and rotatable member in the first direction, in a direction in which the feeding member is moved toward the developer carrying member, and wherein when the pin is disengaged from the slot, by rotation of the swingable and rotatable member in the second direction opposite to the first direction by the urging force of the urging member, the feeding member is moved in a direction in which the feeding member is moved away from the developer carrying member.

14. A developer accommodating unit according to claim 10, wherein the urging member is a torsion coil spring, and wherein an urging force of the torsion coil spring acts on the swingable and rotatable member in a rotational direction of the swingable and rotatable member.

15. A developer accommodating unit according to claim 10, wherein the urging member is a leaf spring, and wherein an urging force of the leaf spring acts on the swingable and rotatable member in a rotational direction of the swingable and rotatable member.

16. A developer accommodating unit according to claim 10, wherein by a number of rotations of the rotatable member and an urging force of the urging member, the maximum acceleration when the feeding member moves toward the developer carrying member and the maximum acceleration when the feeding member moves away from the developer carrying member are set.

17. A developer accommodating unit according to claim 10, wherein the swing shaft and the swingable and rotatable member are rotated integrally with each other by engagement of one end portion of the swing shaft with respect to an axial direction of the swing shaft with the swingable and rotatable member.

18. A developer accommodating unit according to claim 1, wherein the feeding member includes:

a swing shaft which is swingable, and a plate like plate-like arcuate portion mounted on the swing shaft.

19. A developer accommodating unit according to claim 1, wherein the developer carrying member includes, at a surface thereof, an electroconductive portion and a dielectric portion higher in dielectric constant than the electroconductive portion.

20. A developer accommodating unit according to claim 19, wherein at the surface of the developer carrying member, an area occupied by the electroconductive portion is larger than an area occupied by the dielectric portion, and wherein the dielectric portion is disposed so as to be scattered in the electroconductive portion.

21. A developer accommodating unit according to claim 19, further comprising a regulating member provided opposed to the developer carrying member, wherein the regulating member electrically charges the dielectric portion by sliding on the surface of the developer carrying member with the developer, and forms a closed electric field on an adjacent portion where the electroconductive portion is adjacent to the dielectric portion, and the developer fed by the feeding member is attracted to and carried on the surface of the developer carrying member by a gradient force generated by the closed electric field.

22. A cartridge provided so as to be mountable to and dismountable from a main assembly of an image forming apparatus, the cartridge comprising:

a developer accommodating unit according to claim 1.

23. An image forming apparatus for forming an image on a recording material, the image forming apparatus comprising:

a developer accommodating unit according to claim 1 or a cartridge according to claim 22.

24. An image forming apparatus for forming an image on a recording material, the image forming apparatus comprising:

a developer accommodating unit according to claim 1; and driving means configured to drive the moving member.

* * * * *